United States Patent [19]

Murray et al.

[11] Patent Number: 4,974,553

[45] Date of Patent: Dec. 4, 1990

[54] ROTARY INTERNAL COMBUSTION ENGINE

[75] Inventors: Jerome L. Murray, 2 Aldensgate Cir., Budd Lake, N.J. 07828; Joseph O. Mosca, Landing, N.J.

[73] Assignee: Jerome L. Murray, Budd Lake, N.J.

[21] Appl. No.: 478,726

[22] Filed: Feb. 12, 1990

Related U.S. Application Data

[63] Continuation of Ser. No. 277,714, Nov. 30, 1988, abandoned.

[51] Int. Cl.[5] ..... F02B 57/00

[52] U.S. Cl. ..... 123/44 B; 123/44 E; 123/55 AA

[58] Field of Search ..... 123/44 B, 44 E, 55 AA

[56] References Cited

U.S. PATENT DOCUMENTS

| | | | |
|---|---|---|---|
| Re. 26,222 | 6/1967 | Fielder . | |
| 137,261 | 3/1873 | Taylor . | |
| 385,226 | 6/1888 | Barden | 123/44 E X |
| 1,087,240 | 2/1914 | Kellington | 123/55 AA |
| 1,088,623 | 2/1914 | Ragot . | |
| 1,122,972 | 12/1914 | Maye | 123/44 E |
| 1,264,580 | 4/1918 | Tacchi . | |
| 1,282,824 | 10/1918 | Hartson . | |
| 1,324,408 | 12/1919 | Ragot et al. . | |
| 1,528,164 | 3/1925 | Nordwick | 123/55 AA |
| 1,827,094 | 10/1931 | McCann . | |
| 1,874,010 | 8/1932 | Hess . | |
| 1,911,265 | 5/1933 | Crossley . | |
| 1,990,660 | 2/1935 | McCann . | |
| 2,217,796 | 10/1940 | Dell . | |
| 2,807,246 | 9/1957 | Maloney . | |
| 2,920,611 | 1/1960 | Casini . | |
| 2,929,334 | 3/1960 | Panhard . | |
| 3,499,424 | 3/1970 | Rich . | |
| 3,688,751 | 9/1972 | Sahagian . | |
| 3,721,218 | 3/1973 | Null . | |
| 3,747,574 | 7/1973 | Bland . | |
| 3,822,681 | 7/1974 | Townsend . | |
| 3,828,740 | 8/1974 | Townsend . | |
| 3,841,279 | 10/1974 | Burns . | |
| 3,857,372 | 12/1974 | Townsend . | |
| 3,874,348 | 4/1975 | Townsend . | |
| 3,885,533 | 5/1975 | Townsend . | |
| 3,927,647 | 12/1975 | Blackwood . | |
| 3,931,810 | 1/1976 | McGathey . | |
| 3,964,322 | 6/1976 | Kieper . | |
| 3,967,599 | 7/1976 | Townsend . | |
| 4,003,351 | 1/1977 | Gunther | 123/44 B X |
| 4,018,151 | 4/1977 | Urban et al. . | |
| 4,023,536 | 5/1977 | Townsend . | |
| 4,038,948 | 8/1977 | Blackwood . | |
| 4,334,506 | 6/1982 | Albert . | |
| 4,336,686 | 6/1982 | Porter . | |

FOREIGN PATENT DOCUMENTS

| | | | |
|---|---|---|---|
| 619955 | 10/1935 | Fed. Rep. of Germany | 123/44 B |
| 41727 | 10/1913 | Sweden | 123/44 B |

*Primary Examiner*—Michael Koczo

*Attorney, Agent, or Firm*—Curtis, Morris & Safford

[57] ABSTRACT

A rotary internal combustion engine wherein the cylinders making up the engine block are radially disposed in a common plane and rotate with the output shaft. The engine block rotates within a surrounding cam surface and the pistons in each cylinder move radially in and out in a motion geometrically defined by connecting rods, a rocker arm pivoted at a point fixed with respect to the rotating engine block and a cam follower which rides on the cam surface. The rocker arm preferably is counterbalanced to reduce centrifugal forces on the cam surface. The cam surface is contoured to produce the motion to the pistons by means of the linkage as the engine block rotates. The engine block includes a rotary valve port associated with each cylinder. The engine block rotates into cooperating relationship with stationary inlet and exhaust ports in the engine housing to provide intake and exhaust cycles. The power stroke for each cylinder is radially outward and the piston drive linkage and cam slope are arranged to convert the radial forces into shaft torque. The engine has means for varying the compression during operation. A novel oil cooling system with centrifugally assisted circulation is also provided. The rotary engines can be selectively connected in series to form a multibank engine. The rotary engine of the present invention is ideal for powering light airplanes.

17 Claims, 15 Drawing Sheets

FIG. 8

PISTON MOTIONS

| | COL.1 | COL.2 | COL.3 | COL.4 | COL.5 | COL.6 | COL.7 |
|---|---|---|---|---|---|---|---|
| | r | CRANK OR ROTOR ∡ | FIG. 9 HARMONIC PISTON POSITION | 110° PISTON POSITION | CRANKSHAFT PISTON POSITION | 2-STROKE CRANK PISTON POSITION | FIG. 9 POSITION |
| | 1.5 | 0 | 0.000 | 0.000 | 0.000 | 0.000 | 1 |
| | 1.5 | 5 | 0.023 | 0.015 | 0.006 | 0.034 | 2 |
| | 1.5 | 10 | 0.090 | 0.061 | 0.026 | 0.134 | 3 |
| | 1.5 | 15 | 0.201 | 0.136 | 0.057 | 0.295 | 4 |
| | 1.5 | 20 | 0.351 | 0.238 | 0.101 | 0.506 | 5 |
| | 1.5 | 25 | 0.536 | 0.366 | 0.157 | 0.756 | 6 |
| | 1.5 | 30 | 0.750 | 0.518 | 0.224 | 1.031 | 7 |
| | 1.5 | 35 | 0.987 | 0.689 | 0.302 | 1.318 | 8 |
| | 1.5 | 40 | 1.240 | 0.877 | 0.390 | 1.603 | 9 |
| | 1.5 | 45 | 1.500 | 1.077 | 0.496 | 1.875 | 10 |
| | 1.5 | 50 | 1.760 | 1.287 | 0.591 | 2.124 | 11 |
| | 1.5 | 55 | 2.013 | 1.500 | 0.703 | 2.344 | 12 |
| | 1.5 | 60 | 2.250 | 1.713 | 0.820 | 2.531 | 13 |
| | 1.5 | 65 | 2.464 | 1.923 | 0.943 | 2.684 | 14 |
| | 1.5 | 70 | 2.649 | 2.123 | 1.070 | 2.804 | 15 |
| | 1.5 | 75 | 2.799 | 2.311 | 1.199 | 2.893 | 16 |
| | 1.5 | 80 | 2.910 | 2.482 | 1.330 | 2.953 | 17 |
| | 1.5 | 85 | 2.977 | 2.634 | 1.462 | 2.989 | 18 |
| | 1.5 | 90 | 3.000 | 2.762 | 1.594 | 3.000 | 19 |
| | 1.5 | 95 | 2.977 | 2.964 | 1.724 | 2.989 | 20 |
| | 1.5 | 100 | 2.910 | 2.939 | 1.851 | 2.953 | 21 |
| | 1.5 | 105 | 2.799 | 2.985 | 1.976 | 2.893 | 22 |
| | 1.5 | 110 | 2649 | 3.000 | 2.096 | 2.804 | 23 |
| | 1.5 | 115 | 2.464 | 2.962 | 2.211 | 2.684 | 24 |
| | 1.5 | 120 | 2.250 | 2.851 | 2.320 | 2.531 | 25 |
| | 1.5 | 125 | 2.013 | 2.673 | 2.423 | 2.344 | 26 |
| | 1.5 | 130 | 1.760 | 2.435 | 2.519 | 2.124 | 27 |
| | 1.5 | 135 | 1.500 | 2.151 | 2.608 | 1.875 | 28 |
| | 1.5 | 140 | 1.240 | 1.834 | 2.688 | 1.603 | 29 |
| | 1.5 | 145 | 0.987 | 1.500 | 2.760 | 1.318 | 30 |
| | 1.5 | 150 | 0.750 | 1.166 | 2.822 | 1.031 | 31 |
| | 1.5 | 155 | 0.536 | 0.849 | 2.876 | 0.756 | 32 |
| | 1.5 | 160 | 0.351 | 0.565 | 2.921 | 0.506 | 33 |
| | 1.5 | 165 | 0.201 | 0.327 | 2955 | 2295 | 34 |
| | 1.5 | 170 | 0.090 | 0.149 | 2.980 | 0.134 | 35 |
| | 1.5 | 175 | 0.023 | 0.038 | 2.995 | 0.034 | 36 |

FIG. 8 (cont'd)

| | | | | | | | |
|---|---|---|---|---|---|---|---|
| | 1.5 | 180 | 0.000 | 0.000 | 3.000 | 0.000 | 37 |
| | 1.5 | 185 | 0.023 | 0.015 | 2.995 | 0.034 | 38 |
| | 1.5 | 190 | 0.090 | 0.061 | 2.980 | 0.134 | 39 |
| | 1.5 | 195 | 0.201 | 0.136 | 2.955 | 0.295 | 40 |
| | 1.5 | 200 | 0.351 | 0.238 | 2.921 | 0.506 | 41 |
| | 1.5 | 205 | 0.536 | 0.366 | 2.876 | 0.756 | 42 |
| | 1.5 | 210 | 0.750 | 0.518 | 2.822 | 1.031 | 43 |
| | 1.5 | 215 | 0.987 | 0.689 | 2.760 | 1.318 | 44 |
| | 1.5 | 220 | 1.240 | 0.877 | 2.688 | 1.603 | 45 |
| | 1.5 | 225 | 1.500 | 1.077 | 2.608 | 1.875 | 46 |
| | 1.5 | 230 | 1.760 | 1.287 | 2.519 | 2.124 | 47 |
| | 1.5 | 235 | 2.013 | 1.500 | 2.423 | 2.344 | 48 |
| | 1.5 | 240 | 2.250 | 1.713 | 2.320 | 2.531 | 49 |
| | 1.5 | 245 | 2.464 | 1.923 | 2.211 | 2.684 | 50 |
| | 1.5 | 250 | 2.649 | 2.123 | 2.096 | 2.804 | 51 |
| | 1.5 | 255 | 2.799 | 2.311 | 1.976 | 2.893 | 52 |
| | 1.5 | 260 | 2.910 | 2.482 | 1.851 | 2.953 | 53 |
| | 1.5 | 265 | 2.977 | 2.634 | 1.724 | 2.989 | 54 |
| | 1.5 | 270 | 3.000 | 2.762 | 1.594 | 3.000 | 55 |
| | 1.5 | 275 | 2.977 | 2.964 | 1.462 | 2.989 | 56 |
| | 1.5 | 280 | 2.910 | 2.939 | 1.330 | 2.953 | 57 |
| | 1.5 | 285 | 2.799 | 2.985 | 1.199 | 2.893 | 58 |
| | 1.5 | 290 | 2.649 | 3.000 | 1.070 | 2.804 | 59 |
| | 1.5 | 295 | 2.464 | 2.962 | 0.943 | 2.684 | 60 |
| | 1.5 | 300 | 2.250 | 2.851 | 0.820 | 2.531 | 61 |
| | 1.5 | 305 | 2.013 | 2.673 | 0.703 | 2.344 | 62 |
| | 1.5 | 310 | 1.760 | 2.435 | 0.591 | 2.124 | 63 |
| | 1.5 | 315 | 1.500 | 2.151 | 0.486 | 1.875 | 64 |
| | 1.5 | 320 | 1.240 | 1.834 | 0.390 | 1.603 | 65 |
| | 1.5 | 325 | 0.987 | 1.500 | 0.302 | 1.318 | 66 |
| | 1.5 | 330 | 0.750 | 1.166 | 0.224 | 1.031 | 67 |
| | 1.5 | 335 | 0.536 | 0.849 | 0.157 | 0.756 | 68 |
| | 1.5 | 340 | 0.351 | 0.565 | 0.101 | 0.506 | 69 |
| | 1.5 | 345 | 0.201 | 0.327 | 0.057 | 2.295 | 70 |
| | 1.5 | 350 | 0.090 | 0.149 | 0.026 | 0.134 | 71 |
| | 1.5 | 355 | 0.023 | 0.038 | 0.006 | 0.034 | 72 |
| | 1.5 | 360 | 0.000 | 0.000 | 0.000 | 0.000 | 1 |

ROTARY INTERNAL COMBUSTION ENGINE

This application is a division of application Ser. No. 277,714, filed Nov. 30, 1988, abandoned.

FIELD OF THE INVENTION

The present invention relates to internal combustion engines and more particularly to rotary internal combustion engines where the engine block housing the cylinders is directly coupled to an output shaft and the engine block rotates about the axis of rotation of the output shaft.

BACKGROUND OF THE INVENTION

The conventional internal combustion engine is one where the cylinders, either in line or in a V-block, for instance, have the cylinder connecting rods connected to a crank shaft and the crank shaft is rotatably driven by the combustion of the fuel mixture within the cylinders. The typical combustion cycle includes intake of an air-fuel mixture into the cylinder, compression of the air-fuel mixture by the piston, combustion which causes a rapid expansion of the gases within the cylinder to drive the piston and perform work, and the subsequent exhaust stroke evacuating the products of combustion. In a four stroke crank-type engine, the power or expansion stroke occurs once in each 720° of rotation of the crank shaft.

This conventional internal combustion engine also requires an intake and exhaust valve for each cylinder which must be timed to open and close in synchronization with the cycle of the pistons. The valves in a conventional internal combustion engine are poppet valves which have a stem and a mushroom shaped head with edges seating on the periphery of a valve opening and which are opened and closed by synchronized cams. Because the seating faces of the exhaust valves in internal combustion engines are subjected to extremely high temperatures they tend to burn, oxidize or provide a source of pre-ignition. Pre-ignition is frequently a source of damaging engine knock. Accordingly, it is necessary to cool the valve, limit operating temperature and/or maintain a reducing atmosphere during combustion. In a conventional engine this is accomplished by using an excess of fuel, i.e. a rich mixture, over that necessary to support the combustion process. This excess fuel is utilized as a coolant for the exhaust valve as well as insuring that there is no free oxygen at the end of the combustion process, which could oxidize the valves. Because excess fuel is supplied to the cylinders, all the fuel is not completely combusted and unburned hydrocarbons from the uncombusted fuel are exhausted through the exhaust valves and the exhaust manifold system rather than contributing to the output power. Because of this, the exhaust gas from the internal combustion engine pollutes the atmosphere excessively.

The use of the crank shaft in a conventional internal combustion engine causes a kinematic limitation to the motion of the piston. That is, the translation of the reciprocating motion of the piston to rotary motion by means of a crank causes the piston to reciprocate up and down in the cylinder in the characteristic crank-slider motion, which is a higher order, non-sinusoidal motion. This characteristic crank-slider motion cannot be conveniently altered and is symmetric for each stroke, because it is fixed by the geometry of a crank/connecting rod assembly. The crank-slider motion of the piston in a conventional internal combustion engine is disadvantagous for several reasons, including: 1) crank-slider motion generates higher inertial stresses than does pure sinusoidal motion, 2) crank-slider motion results in increased time at or near top dead center ("TDC"), increasing the likelihood of pre-ignition, 3) increased dwell time results in increased heat loss to the engine both before and after firing, and 4) the torque arm just after firing is small, under utilizing the high gas pressures and 5) the torque arm near the end of the the stroke when pressure is low, i.e. near bottom dead center ("BDC") is too small for effective capture of the motive force in this gas. Furthermore, the crank-slider motion does not closely match the heat and pressure conditions as a function of time that are created in the combustion chamber during the operation of the engine.

In spark ignition engines the longer the time period that the air-fuel mixture is compressed the greater likelihood there is of pre-ignition. Because the upward rise of the piston in a conventional engine is relatively slow near TDC, the compressed air-fuel mixture is at or near its maximum compression during a relatively long period of time prior to top dead center. For this reason, relatively low compression ratios and/or high octane fuels are required to prevent pre-ignition.

Immediately after passing top dead center and beginning its downward expansion stroke, the piston in a crank-type engine is also moving relatively slowly. In both spark-ignition engines and compression-ignition (i.e. Diesel) engines, the relatively slow motion of the piston near top dead center causes excessive heat loss because of the relatively long length of time that the hot combustion gases are in contact with the head and cylinder walls. Finally, the crank-slider motion of the piston near the end of its stroke, that is near bottom dead center, where the pressures are the lowest, makes it difficult to effectively utilize the available motive force in the gases, due to the pressures involved coupled with the short effective arm of the crank at this position. Thus, in conventional engines, the exhaust valve begins to open a significant number of degrees before bottom dead center, resulting in a significant loss of available energy of the combusted gases.

Furthermore, in a crank-type engine, the intake stroke of the piston in a four stroke engine is inherently the same length as the expansion stroke. Because of the increase in temperature and pressure caused by combustion, at the bottom of the expansion stroke (even if the exhaust valve were not to be opened until bottom dead center), the combusted gases will still be at a higher pressure than ambient. Thus, significant loss in available motive force in the combusted gases occurs when the exhaust valve opens and exhausts the higher than ambient pressure gas to ambient pressure. Various mechanisms combined with the crank/connecting rod system have been proposed to try to capture more of this available work through more complete expansion, but have not proven successful due to their cost and mechanical complexity. For example, the Atkinson mechanism provides a crank/connecting rod system with a longer expansion stroke than intake stroke, but at greatly increased mechanical complexity.

Moreover, the octane quality of commercially available fuels, which affects the permissible compression ratio, varies considerably. Making provision for variable compression ratio in the cylinders would allow the maximum permissible compression ratio for a given fuel, and hence highest efficiency for a given fuel. However, efforts to make internal combustion engines with variable compression ratios have not proven very successful in practice due to mechanical complexity. Thus, conventional internal combustion engines have non-adjustable compression ratios and engine manufacturers must design compression ratios to accept the poorest available fuel. This compromise results in an engine having a lower compression ratio than the optimum, and hence a lower efficiency than the optimum for an average fuel. Gasoline manufacturers sell "super" octane gasoline, therefore conventional engines designed for poor fuel derive no benefit from using these costly "super" fuels.

In an attempt to alleviate some of the difficulties of the crank-type internal combustion engine, various rotary engine designs have been proposed where the engine block housing the cylinders and pistons of the engine is directly coupled to the output shaft of the engine and the entire block, with the assembly of cylinders and pistons, rotates along with the output shaft. In one such rotary engine proposal, U.S. Pat. No. 4,023,536, each piston has a roller which rolls against the interior surface of a cam to translate the reciprocating motion of the piston to rotary motion of the engine block rotor, instead of by means of a crank and connecting rod as in a crank-type engine.

Although the use of a cam overcomes the inherent kinematic limitations of a crank mechanism, these rotary designs have not been entirely successful. In such rotary engine designs the cam acts directly upon the roller which is directly conected to the piston. Since it is the tangential (i.e. side) component of force from the cam surface which causes rotation of the engine block, and hence the useful power output, these forces can only be transmitted to the engine block in these designs by means of side forces on the piston against the cylinder walls. These side forces and friction contribute to excessive wear on the piston and cylinder in these prior art designs.

Furthermore, because the entire engine block and pistons rotate in a rotary engine, centrifugal force tends to throw the piston outward against the cam. These centrifugal forces are very large in magnitude, tend to increase wear on the cam surface and cam roller in prior art rotary engine designs, thereby limiting engine speeds adversely.

In rotary engines, the engine block with the cylinders rotates within a housing. Because of this, cooling the cylinders has proven difficult in prior art designs, because delivering sufficient air or water to a rotating assembly of cylinders presents mechanical and sealing difficulties.

These and other problems have thus far prevented the the practical implementation of a rotary engine design.

OBJECTS OF THE INVENTION

Accordingly, it is an object of the present invention to provide an internal combustion engine utilizing a rotating engine block coupled directly to the output shaft of the engine which overcomes the foregoing disadvantages.

It is a further object of the present invention to provide a rotary internal combustion engine of increased efficiency and exhibiting lower unburned hydrocarbon and $NO_x$ emissions than conventional internal combustion engines.

Another object of the present invention is to provide a rotary internal combustion engine which avoids problems of excessive side wear on the pistons.

Still another object of the present invention is to provide a rotary internal combustion engine which avoids problems of the centrifugal forces acting on the pistons to cause excessive force and wear upon the cam track surface and cam follower, and to provide a force tending to return the piston to TDC.

Yet another object of the present invention is to provide a rotary internal combustion engine of the character described wherein increased efficiency is obtained from the power stroke of each of the cylinders because of a unique design of the stationary cam surface on which the connecting rods act.

A still further object of the present invention is to provide a rotary internal combustion engine which has a capability of developing a power stroke during more than 110° of rotation of the output shaft for each cylinder.

A further object of the present invention is to provide an internal combustion engine having a smooth power output and a low idle speed.

A still further object of the present invention is to provide a rotary internal combustion engine wherein provision can be made to vary the compression ratio within the cylinders during operation to optimize performance.

Still another object of the present invention is to provide an internal combustion engine having decreased emissions of hydrocarbon pollutants and oxides of nitrogen.

Yet another object of the present invention is to provide an rotary engine cooled by oil in a novel manner.

Yet another object of the present invention is to provide a rotary internal combustion engine wherein one or more of the pistons can be selectively locked or unlocked depending upon engine operating parameters to provide variable engine displacement and more efficient engine operation.

Still another object of the present invention is to provide an ideal power plant for a light propeller driven airplane.

SUMMARY OF THE INVENTION

In accordance with an embodiment of the present invention, a rotary internal combustion engine is provided which has a housing, a cam track internally disposed within the housing and adapted to receive a cam follower, and a rotatable engine block disposed within the housing and rotatable about a central axis. The block includes an axially extending output shaft and at least one radially arranged cylinder assembly on the block. Each cylinder assembly has a cylinder having a longitudinal axis extending generally radially outwardly from the rotational axis of the block and means defining an end wall on the cylinder. A piston member is disposed within the cylinder and is adapted to reciprocate within the cylinder. The piston includes a head end which together with said cylinder and its end wall defines a combustion chamber. Means permitting periodic introduction of air and fuel into the combustion chamber, means for causing combustion of a compressed mixture of air and fuel within the combustion chamber, and means permitting periodic exhaust of products of combustion of air and fuel from the combustion chamber are provided. The engine also includes means for imparting forces and motions of the piston within the cylinder to and from the cam track comprising linkage means and a cam follower operatively connected to the linkage means. The linkage means comprises a connecting rod having a first end portion pivotally connected to the piston member, a second end portion and a rocker arm. The rocker arm has a first end portion pivotally mounted to a mounting point fixed with respect to the block and offset with respect to the longitudinal axis of its associated cylinder, a second end portion pivotally connected to the second end portion of the connecting rod, and an arm portion connecting the first and second end portions of the rocker arm. The cam follower is adapted to ride along the cam track so that the cam follower forces and motions are transmitted to and from the piston, through the linkage means, to and from the cam track. The cam track includes at least a first segment and at least a second segment thereof. The first segment has a positive slope wherein the cam track segment has a generally increasing radial distance from the rotational axis of the engine block whereby as a piston moves outwardly in a cylinder on a power stroke while the cam follower is in radial register with the cam track segment, the reactive force of the respective cam follower through the linkage means against the cam track segment acts in a direction tending to impart rotation to the engine block in the direction of the positive slope of the cam track segment. The second segment has a negative slope wherein the cam track segment has a generally decreasing radial distance from the rotational axis of the engine block whereby as a cam follower rides along the negative slope of the cam track as said engine block rotates, the cam follower will cause a geometrically defined motion of the linkage means to compel a radially inward motion of the respective piston in its respective cylinder.

BRIEF DESCRIPTION OF THE DRAWINGS

These and other objects, features and advantages of the present invention will become apparent to those skilled in the art upon reading the following description in conjunction with the figures, wherein:

FIG. 8 is a table of the values of piston motion used to generate FIG. 7.

DETAILED DESCRIPTION

Figure 3:
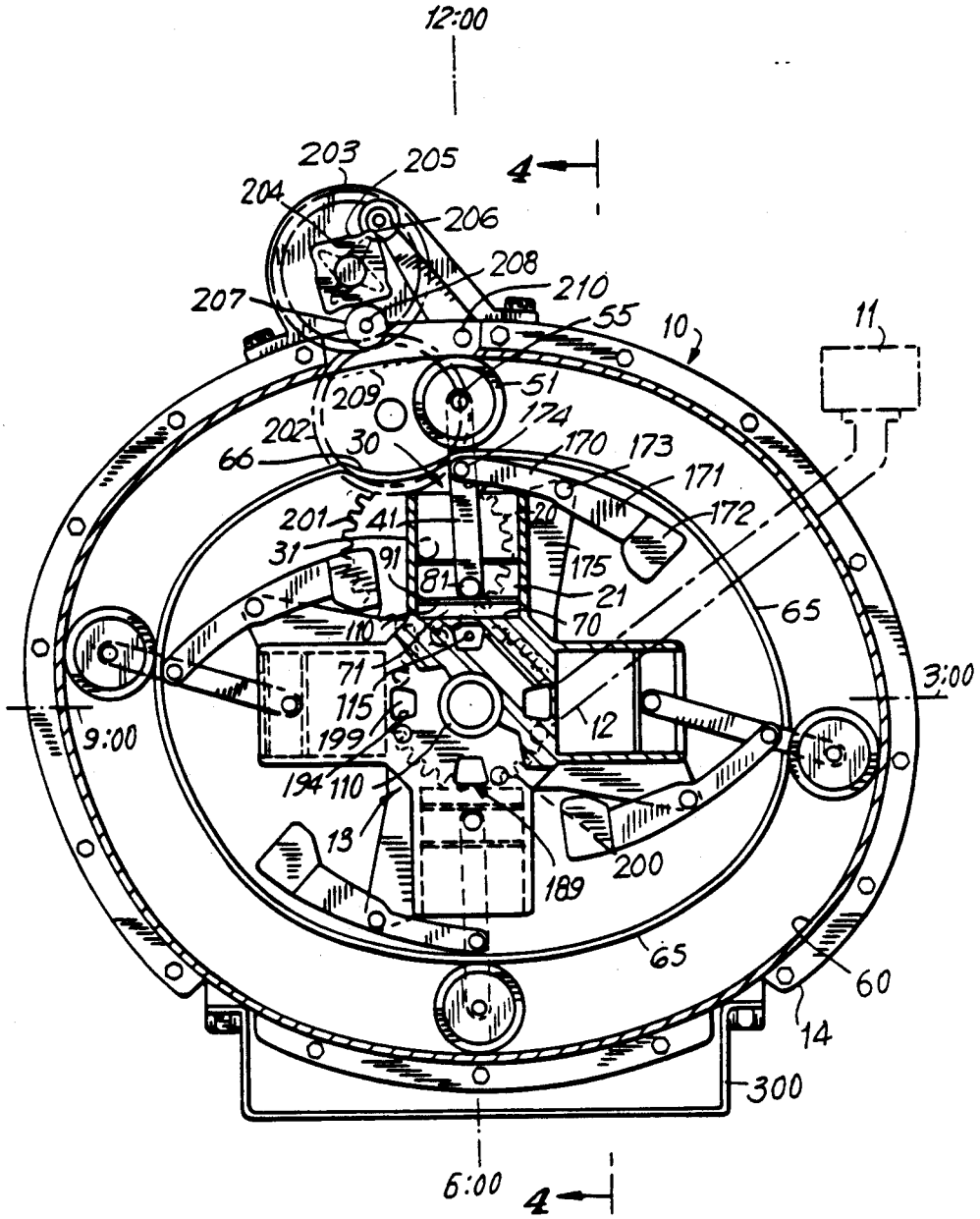
FIG. 3 is a diagrammatic end view of another embodiment of the engine of the present invention, showing one embodiment of means for affecting the compression of the engine and a different embodiment of the linkage means.
Figure 4:
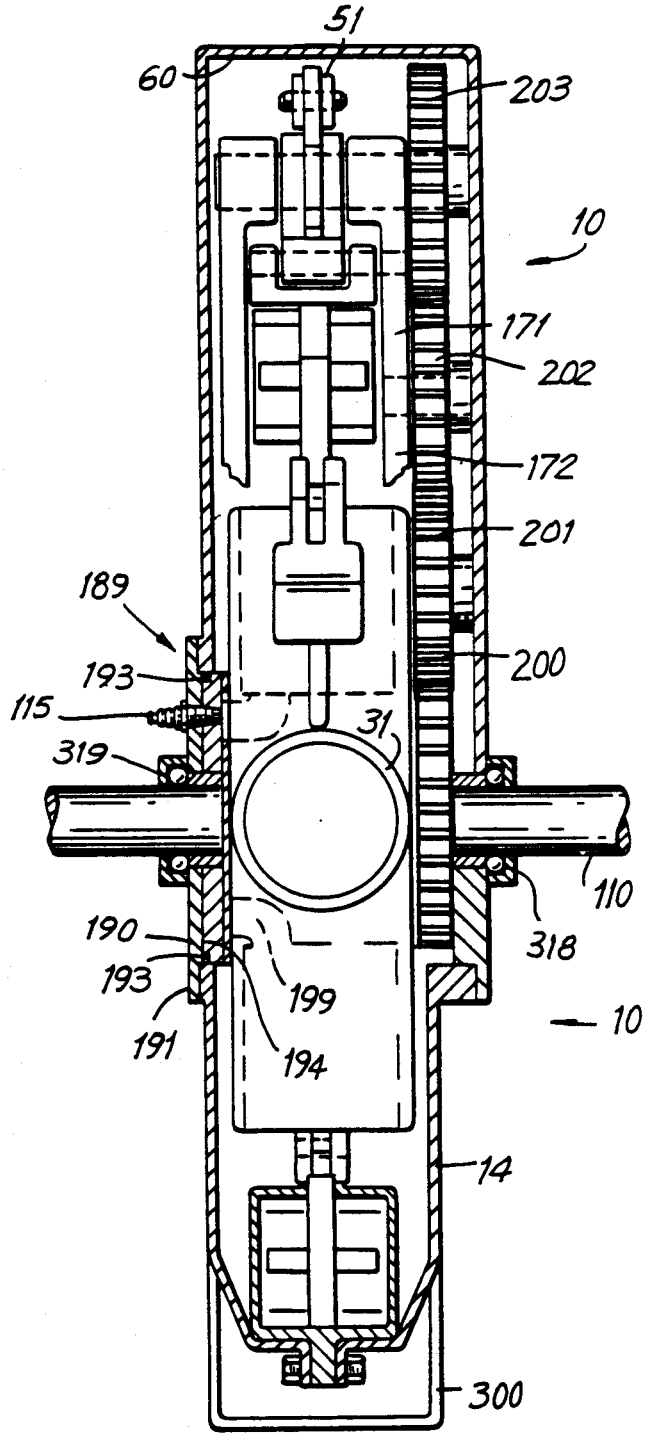
FIG. 4 is a diagrammatic side view, partly in section, of the embodiment of the engine depicted in FIG. 3, taken along the line 4—4.

With reference to the figures, and initially to FIGS. 3 and 4 thereof, a rotary internal combustion engine 10 in accordance with one embodiment of the present invention is depicted. Engine 10 is a four stroke, spark ignition engine with a carburetor 11, intake pipe 12 leading to rotary valve assembly 189, and spark plug 115. A four stroke compression ignition (Diesel) cycle could also be employed, in which case carburetor 11 and spark plug 115 would be replaced with fuel injection directly into the cylinder. Two stroke spark ignition and compression ignition cycles could also be used.

Engine 10 includes a rotatable engine block 13 coupled to an output shaft 110 which extends axially from each end of the rotatable engine block 13 to provide a means of translating the rotation of the engine block 13 into useful work. Output shaft 110 is supported by inboard bearing 318 and outboard bearing 319 which extend axially from housing 14, which contains engine block 13 and permits its rotation. Bearing 318 and 319 are preferably conventional journal bearings, but other bearings such as ball or roller bearings could also be provided. Instead of an output shaft 110, other means such as a gear drive, chain drive, hydraulic drive, directly coupled electromagnetic generator or other means for capturing the useful work could also be provided. Furthermore, the engine in accordance with the present invention can also operate where the engine block 13 is held stationary, and the housing 14 allowed to rotate. In this case, the output shaft or other means would be connected to the housing 14.

Rotatable engine block 13 includes four radially arranged cylinder assemblies 30, which are preferably, though not necessarily, identical. Only one of these cylinder assemblies will be described in detail, and the same description would apply to the other three cylinder assemblies. It should be recognized, however, that the invention is not limited to four cylinder assemblies, or any particular number of cylinder assemblies.

Each of cylinder assemblies 30 includes a cylinder 31, within which a piston 21, preferably made of low inertia material such as aluminum, is reciprocally and slidably disposed. Piston 21 includes piston rings 91, preferably made of cast iron or steel.

Each cylinder assembly 30 includes an end wall at its radially inwardmost point, which is preferably a cylinder head 70, and a port opening 199. Each of pistons 21 include a crown or piston head 101. The space between piston head 101 and cylinder head 70, together with port opening 199, forms combustion chamber 71.

In order to introduce air and/or fuel into each of the combustion chambers 71, a rotary valve assembly 189 is included. This rotary valve assembly is best seen in FIGS. 2 2A, 3 and 4, and is preferably axially mounted at one end of output shaft 110. Port opening 199 in combustion chamber 71 functions as both an intake and exhaust port, and exposes the combustion chamber to the spark plug or diesel injection. This opening or port 199 extends through a rotating seal face 194, which is arranged to sealably face and rotate against a static seal plate 190 (not visible on FIG. 3). Static seal plate 190 is preferably mounted to housing 14 with output shaft 110 extending centrally through it. As shown in FIG. 2A, static seal plate 190 includes an intake port 196, and exhaust port 195 and a blanked-off portion containing no opening 197.

In operation, as engine block 13 rotates clockwise, port 199 will rotate into register with exhaust port 195 during the portion of the cycle wherein exhaust gases are to be discharged from combustion chamber 71. After the piston reaches the end of its exhaust stroke, the engine block 13 and opening 199 in rotating seal face 194 will rotate into register with intake port 196 and will remain in register with this intake port during the entire intake stroke. Following the intake stroke, as the engine block 13 continues to rotate, port 199 will move into register with blanked-off portion 197 of static seal plate 190 during the compression stroke. At the completion of the compression stroke, combustion will be initiated in the combustion chamber 71 by either compression-ignition, in a Diesel version, or initiation by means of a spark through port 199 in a spark ignition version. As the engine block 13 continues to rotate, opening 199 will remain in register with blanked-off portion 197 of static seal plate 190 until the expansion stroke is substantially complete, at which point opening 199 rotates into register with exhaust port 195 to commence the cycle again.

Figure 2:
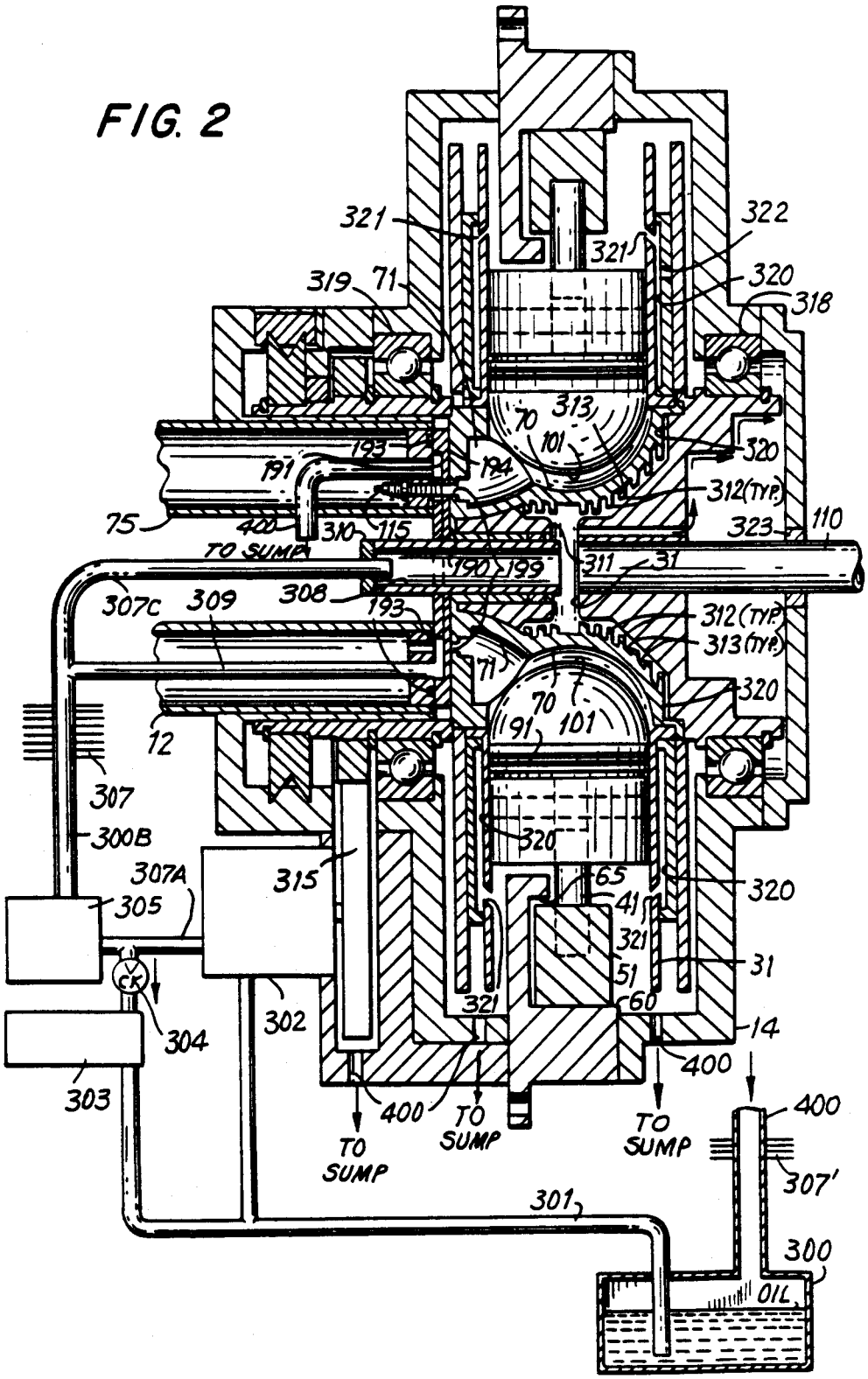
FIG. 2 is a diagrammatic side view of the rotary engine depicted in FIG. 1, taken along the line 2—2 of FIG. 1, and a diagrammatic representation of the oil cooling and lubricating system in accordance with a preferred embodiment of the present invention.
Figure 2A:
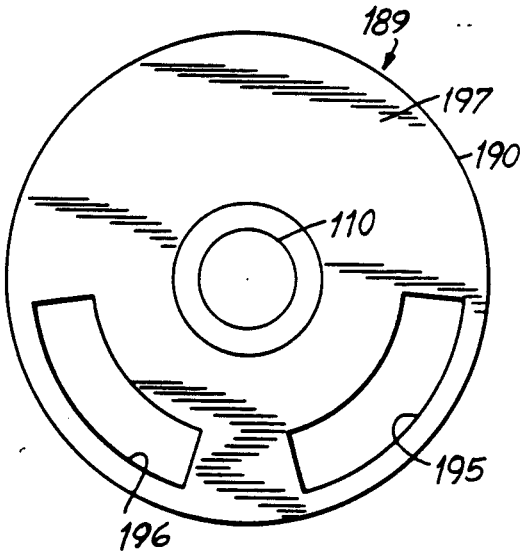
FIG. 2A is an end view of the static seal plate of the rotary valve of a preferred embodiment of the present invention.

As best seen in FIG. 2, the rear face 191 of static seal plate 190 is open to an oil conduit 309, which circulates oil adjacent rear face 191 and to oil return line 400. Gaskets 193 prevent leakage of this cooling oil out of the engine. Circulation of oil cools the static seal 190 directly, and the rotating seal face 194 of rotary valve assembly 189 indirectly by conduction. Instead of oil, water or other fluid could be used. Thus, the rotary valve assembly 189 can be kept at a temperature below that at which excessive oxidation would occur. Furthermore, the heated oil or fluid can be used to provide passenger comfort heat. Because the temperature of the valve is low, it is not necessary to use excessive fuel during combustion to prevent oxidation of the valves, as is the case with conventional poppet valves. This results in better fuel economy and lower emission of hydrocarbons and carbon monoxide, which otherwise result from rich fuel mixtures of prior art engines.

Furthermore, the engine of the present invention lends itself to greatly simplified ignition, and intake and exhaust manifolds. As shown in FIGS. 3 and 4, the engine has a "single point" intake 12 and a "single point" exhaust pipe 75, and a single spark plug, even though the engine has four cylinders. In a conventional four cylinder engine, complex and heavy intake and exhaust manifolds would be required, as well as four spark plugs and associated distributor and wiring. The "single point" intake is of especially great advantage in Diesel embodiments of the present invention. In a conventional engine, an injection pump is required for each cylinder. In small engines, this multipoint fuel injection system can cost as much as the rest of the engine. In the present invention, only a single injection pump would be required, regardless of the number of cylinders.

Returning now to FIG. 3, to transmit forces and motions to and from the piston into useful work (i.e. rotation of engine block 13 and shaft 110), a connecting rod 41 is pivotally connected at its upper end to piston 21 by means of wrist pin 81. At the opposite end of connecting rod 41, a cam follower 51 is rotatably mounted about an axle 55. In the embodiment shown, the cam follower is preferably a rotatable wheel to minimize wear and friction. However, a sliding cam follower, rather than a rolling cam follower, may also be employed.

Connecting rod 41 is linked by means of link arm or rocker arm 170 at a pivot 174 on the connecting rod 41 between axle 55 and pivot 81. The opposite end of rocker arm 170 is rockably pivoted about rocker arm pivot 173, which is mounted on mounting plate 175 which is affixed to and rotates with engine block 13. Pivot 173 is offset with respect to the centerline of cylinder 31 and causes the connecting rod 41 and cam follower 51 to move in a kinematically defined path as piston 21 reciprocates.

Cam follower 51 is adapted to follow and roll about the inside periphery of cam track 60 as engine block 13 rotates clockwise. Cam track 60 has a generally ellipsoid shape which is preferably generally anti-symmetrical across a 12:00/6:00 line. By "anti-symmetrical" is meant that if one were to cut the cam track at the 12:00/6:00 line, and turn one side of the cam track over about approximately the 9:00/3:00 line, the reversed cam track would then be symmetrical across the 12:00/6:00 line. The reason for the anti-symmetry is the geometry of the connecting rod/linkage assembly with the rocker arm rocker pivot on each cylinder being positioned leading the centerline of its respective cylinder (i.e. more clockwise than cylinder centerline). Thus, anti-symmetry of cam track 60 causes pistons opposing one another to have the same radial position and reciprocal speed at a given rotor angle (but oppositely directed), resulting in less dynamic unbalance of the engine due to reciprocating masses.

The roughly 12:00 position of the track in FIG. 3 corresponds to top dead center of the compression stroke, the roughly 3:00 position corresponds to the bottom dead center of the expansion stroke, the roughly 6:00 position corresponds top dead center of the exhaust stroke, and the roughly 9:00 position corresponds to the bottom dead center of the intake stroke. Thus, a 360° rotation of engine block 13 corresponds to a complete four stroke cycle.

The cam track segment between the 12:00 top dead center angular position and the 3:00 bottom dead center angular position has a generally positive slope so that the radial distance between a point on cam track 60 and the center of rotation of engine block 13 generally, preferably continuously, increases between these angular positions of the engine block. Similarly, the cam track segment between the 3:00 bottom dead center angular position and the 6:00 top dead center position has a generally negative slope so that the radial distance between a point on cam track 60 and the center of rotation of engine block 13 generally, preferably continuously, decreases between these angular positions of the engine block.

Figure 1:
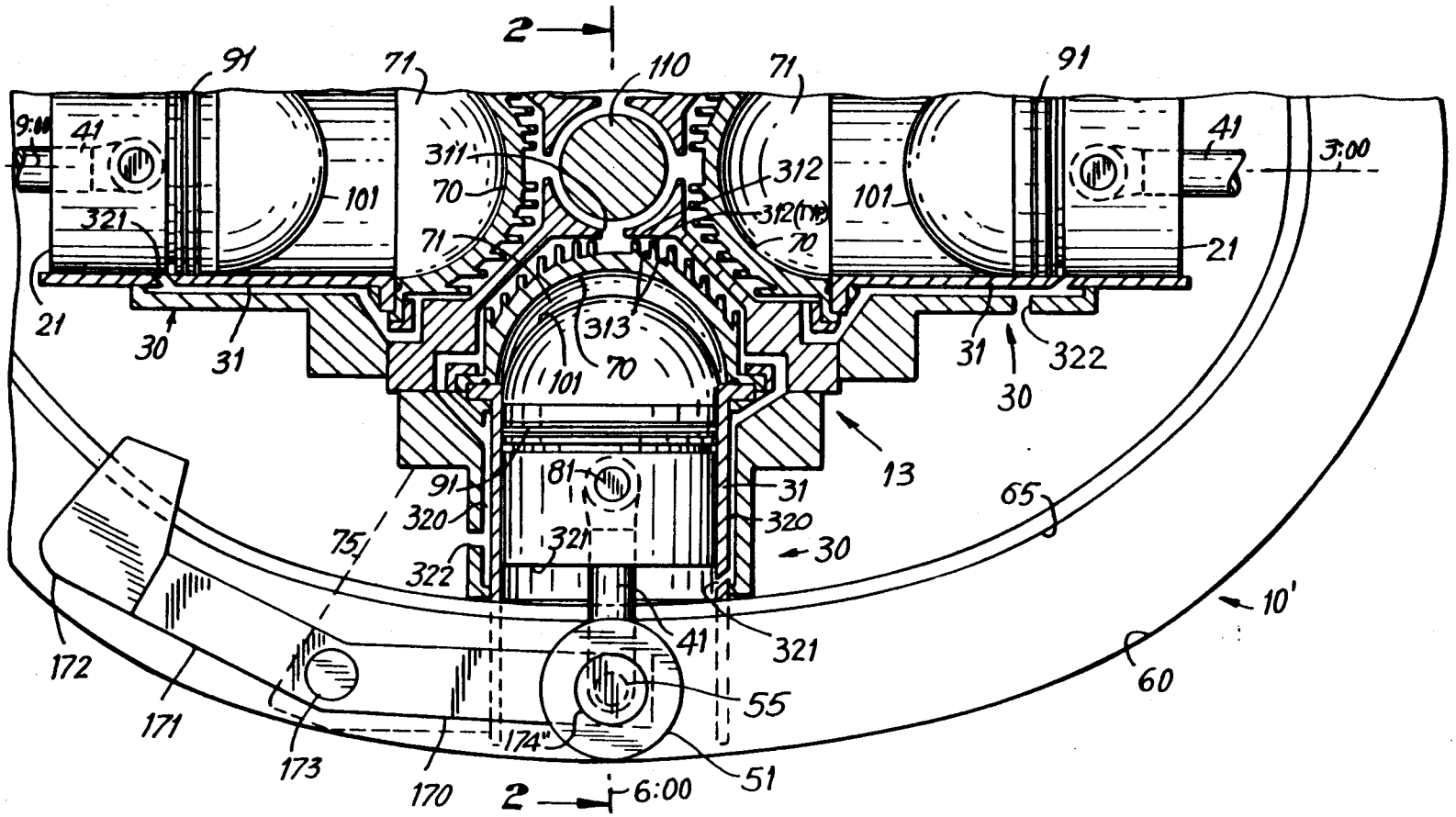
FIG. 1 is a diagrammatic end view of a cutaway portion of a preferred embodiment of the rotary engine of the present invention, showing one complete cylinder assembly and portions of two other cylinder assemblies in their respective relative positions on the engine block.

As shown in FIGS. 1, 2 and 3, an inner cam track 65 is also preferably provided substantially parallel with outer cam track 60, and radially inwardly of cam follower 51. The purpose of inner cam track 65 to to ensure that cam follow 51 remains substantially adjacent to cam track 60, that is, that is does not go radially inward of cam track 60, particularly during intake and exhaust strokes when there is relatively little pressure in combustion chamber 71 acting on piston 21. Particularly in embodiments of the present invention where rocker arm extension 171 (and 171') and counterweight 172 (and 172') are used to counterbalance centrifugal forces in a manner to be further, explained, at low engine speeds it is possible for centrifugal forces acting upon the piston/connecting rod/cam follower assembly to be insufficent to overcome friction during intake and exhaust strokes. Inner cam track 65 provides a means for applying a radially outward force on cam follower 51 to avoid this. Instead of an inner cam track, other means of ensuring that cam follower 51 remains substantially adjacent to cam track 60 may be provided, such as a spring to urge cam follower 51 outwardly aganist cam track 60, or a mechanical stop or bumper to prevent movement of the piston/connecting rod/linkage assembly beyond TDC.

As engine block 13 rotates, cam follower 51 traverses cam track 60. As the radial distance between a point on cam track 60 and the rotational axis of the engine block 13 increases and decreases, cam follower 51 moves radially inwardly and outwardly to transmit forces and motions to and from the cam track to from piston 21 by means of the connecting rod/rocker arm linkage assembly. Where the slope of cam 60 is positive (or negative), there is a tangential, or "side" component of force acting between cam follower 51 and cam track 60. It is this tangential component of force which, of course, causes rotation of engine block 13, and hence the power output of the engine. Correspondingly, the oppositely directed tangential force causes the piston to move radially inwardly during the exhaust and compressions strokes. Rocker arm 170 transmits a large proportion of the tangential component of force acting upon cam follower 51 by cam track 60 to mounting plate 175. In this way, forces imparted by the cam track 60 in a direction tending to rotate engine block 13 in either direction are not primarily transmitted by means of side forces acting upon the piston within its cylinder, as is the case with the prior art, but rather by means of the external linkage arrangement. Thus, side forces which would otherwise tend to prematurely cause wear on the piston are minimized. Furthermore, because the rocker pivot 173 is at a radially farther position than the average piston position, a greater lever arm is available for the transmission of torque.

Figure 12:
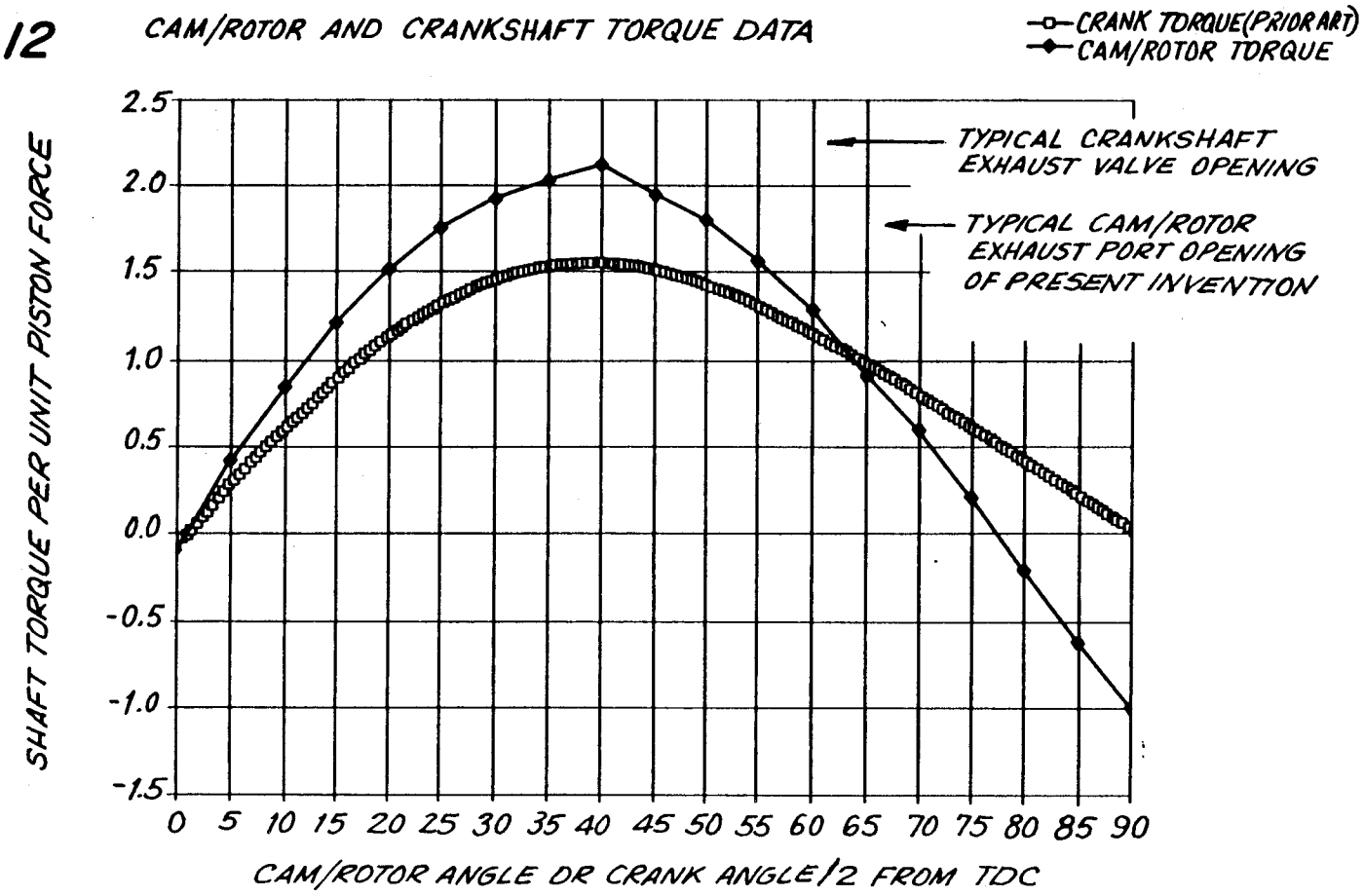
FIG. 12 is a graph of engine torque divided by cylinder pressure as a function of rotor angle for a rotary engine in accordance with the present invention having a simple harmonic motion, and a graph of engine torque divided by cylinder pressure for an equivalent conventional crank engine as a function of one half the crank angle.

The increased torque capability of the engine of the present invention as compared to an equivalently sized crankshaft-type engine is depicted diagrammatically in FIG. 12. The engines are equivalent in the sense of having the same piston area and stroke.

The absissa of the graph of FIG. 12 is the cam/rotor angle of an engine in accordance the present invention, having pure harmonic piston motion and one half the crank angle for an equivalent sized crankshaft-type engine. This is done because one revolution of the rotor of the present invention is equivalent to two for the crankshaft of a conventional engine. As can be seen from the graph, calculated torque per unit piston force is significantly higher for the engine of the present invention than for the equivalent conventional engine from 5° through 60° of rotor angle. Although the torque for the rotor of the present invention begins to drop sharply thereafter, dropping to less than the conventional engine, this is approximately the point at which the exhaust port or valves open, thus relieving the cylinder of pressure in any event. Thus, during substantially the entire period of rotation when useful work can be extracted from the gas (i.e. prior to opening the exhaust valve or port), the torque output of the present invention is substantially greater than that of a conventional engine, resulting in higher power output and efficiency.

Rocker arm 170 preferably includes an extension link 171 extending beyond pivot 173 and including counterweight 172 at its extreme or free end. Extension link 171 and counter-weight 172 are weighted to substantially counterbalance centrifugal forces acting upon piston 21, connecting rod 41, cam follower 51 and link arm 170. These forces tend to throw piston 21 and these parts radially outwardly against the cam track surface 60, tending to increase wear on the cam track follower and cam track surface 60. Link extension 171 and counterweight 172 are arranged so that link arm 171 and counter-weight 172 tend to move radially inwardly as piston 21 moves outwardly, thus tending to substantially counteract the centrifugal forces. However, preferably the weight of the counterweight is such that this does not completely offset the centrifugal forces, so that the piston and cam follower are urged into contact with the cam track surface. In this way, excessive wear due to centrifugal forces acting upon the cam track follower 51 and cam track 60 are minimized.

Figure 5:
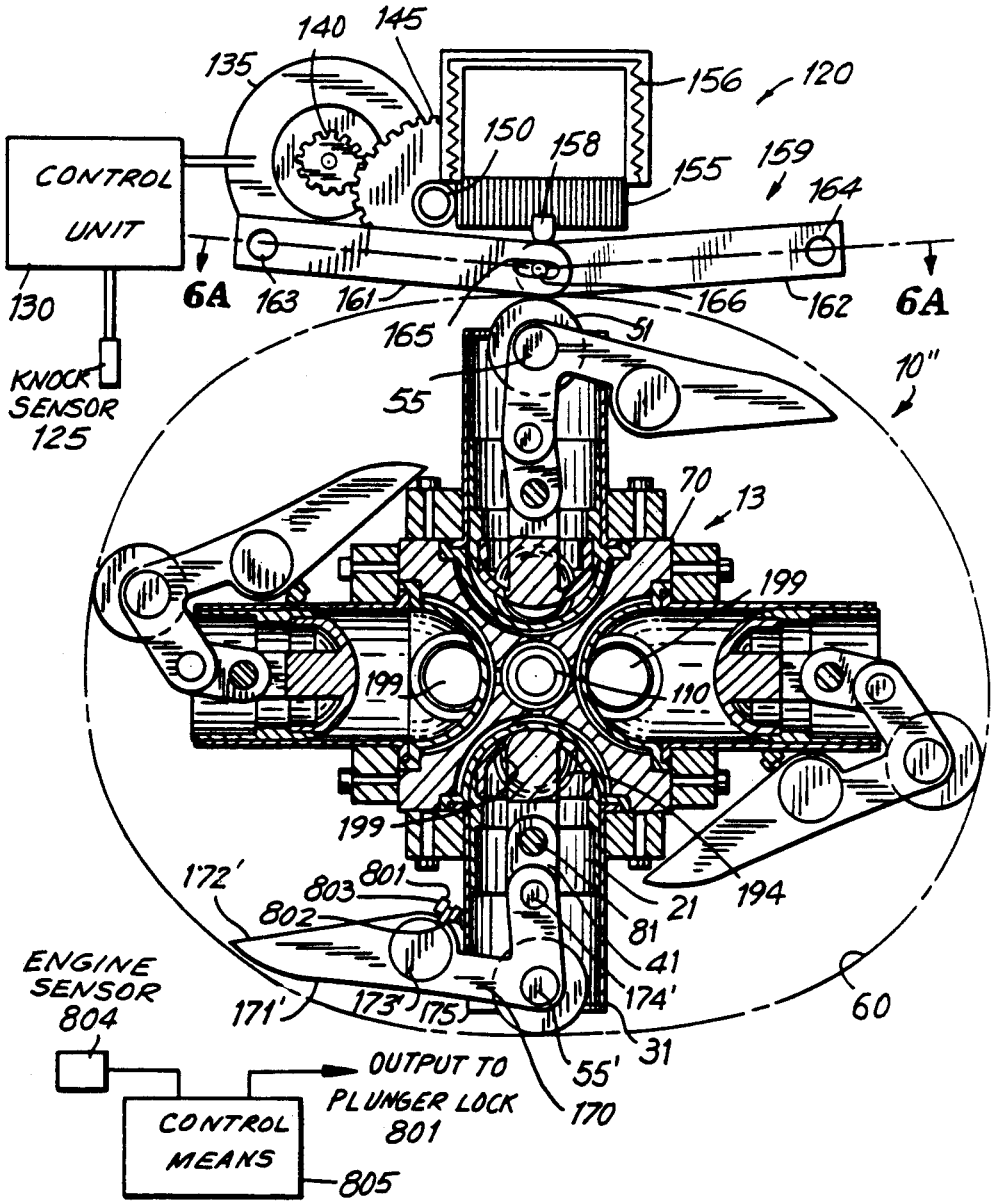
FIG. 5 is a diagrammatic sectional end view of still another embodiment of the present invention including a variation of the linkage means in accordance with the present invention, and showing means for selectively preventing pistons from reciprocating.

The arrangement of linkages with respect to connecting rod 41 as depicted in FIG. 3 is not the only arrangement that can be used to accomplish the purposes of the present invention. For example, in FIG. 1, another embodiment of the engine 10' is depicted. In this embodiment link 170 is connected to connecting rod 41 at the radially extreme end of connecting rod 41 by means of pivot 174'' which is coaxial with axle 55 for cam follower 51. In another embodiment, engine 10'' is depicted in FIG. 5. In this embodiment, cam follower 51 is connected to link arm 170' at the apex of a "V"-shaped bend in link arm 170', rather than being pivotally connected to connecting rod 41. In this embodiment, connecting rod 41 is relatively short, and the radially extreme end of connecting rod 41 is pivoted to link 170' by means of pivot 174'. Link 170' is pivotally mounted at pivot 173', which is in turn mounted to mounting plate 175. In this embodiment, extension link 171' and counter weight 172' are integral with one another.

Cam surface 60 is profiled so as to translate the reciprocating motion of piston 21 through the linkage assembly into rotary motion of engine block 13, and hence output shaft 110. Because the rotary engine of the present invention has no crank, the inherent kinematic limitations of the crank-slider motion of a piston with a crank arrangement are eliminated. Thus, the shape of cam surface 60 can be tailored to assume whatever profile best suits the heat and pressure characteristics of the combustion process and/or any other design parameters required.

Figure 9:
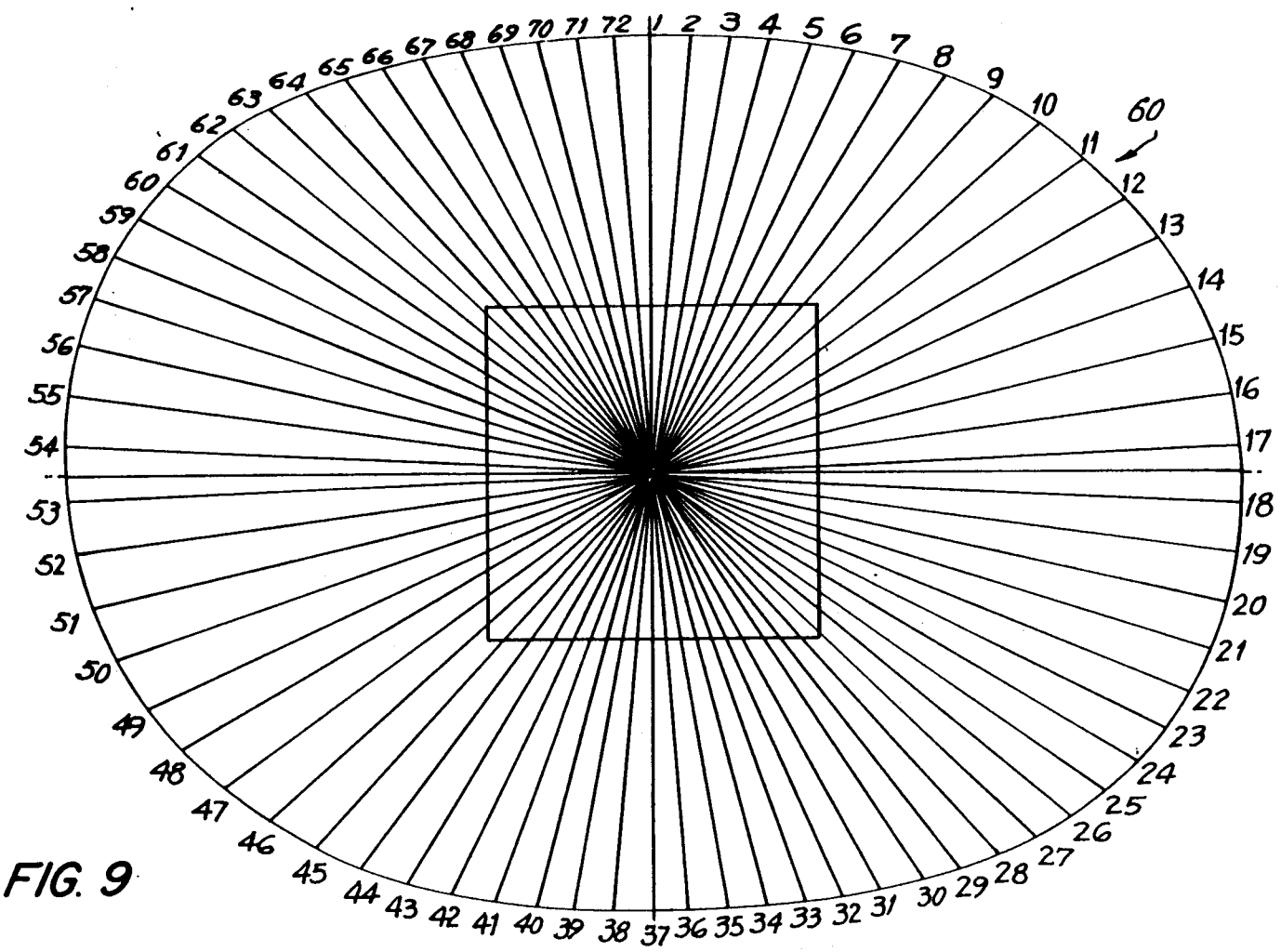
FIG. 9 is a diagrammatic representation of a cam profile in accordance with a preferred embodiment of the present invention, with numbers on the periphery of the cam profile corresponding with the position numbers on the table of FIG. 8.

One embodiment of a cam profile is depicted in FIG. 9. As depicted therein, the cam profile is a substantially anti-symmetrical ellipsoid. The profile of FIG. 9 has points 1–72 indicated about its periphery.

FIG. 8 is a tabulation of the relative piston radial reciprocal position as a function of rotor angle (Col. 2) for a cam follower 51 having a radius "r" of 1.5 inches (Col. 1). Each of the peripheral points 1–72 on FIG. 9 corresponds to a crank or rotor angle position as indicated in Col. 7 of FIG. 8, beginning at crank or rotor angle of 0° at position 1. Pure harmonic (i.e. sinusoidal) piston motion is tabulated in Col. 3, which is the piston motion generated by the cam profile of FIG. 9. A configuration where the expansion stroke continues during 110° of rotor rotation is tabulated in Col. 4. The calculated piston motion for a corresonding four stroke crank type engine are tabulated in Col. 5 for a true 720° cycle, and in Col. 6 for a two stroke crank type engine having a 360° cycle for comparison.

The pure or simple harmonic configuration is preferable in high-speed rotary engine designs, because it results in lower inertial stresses on the piston caused by reciprocation of the piston than crank-slider motion.

Figure 13:
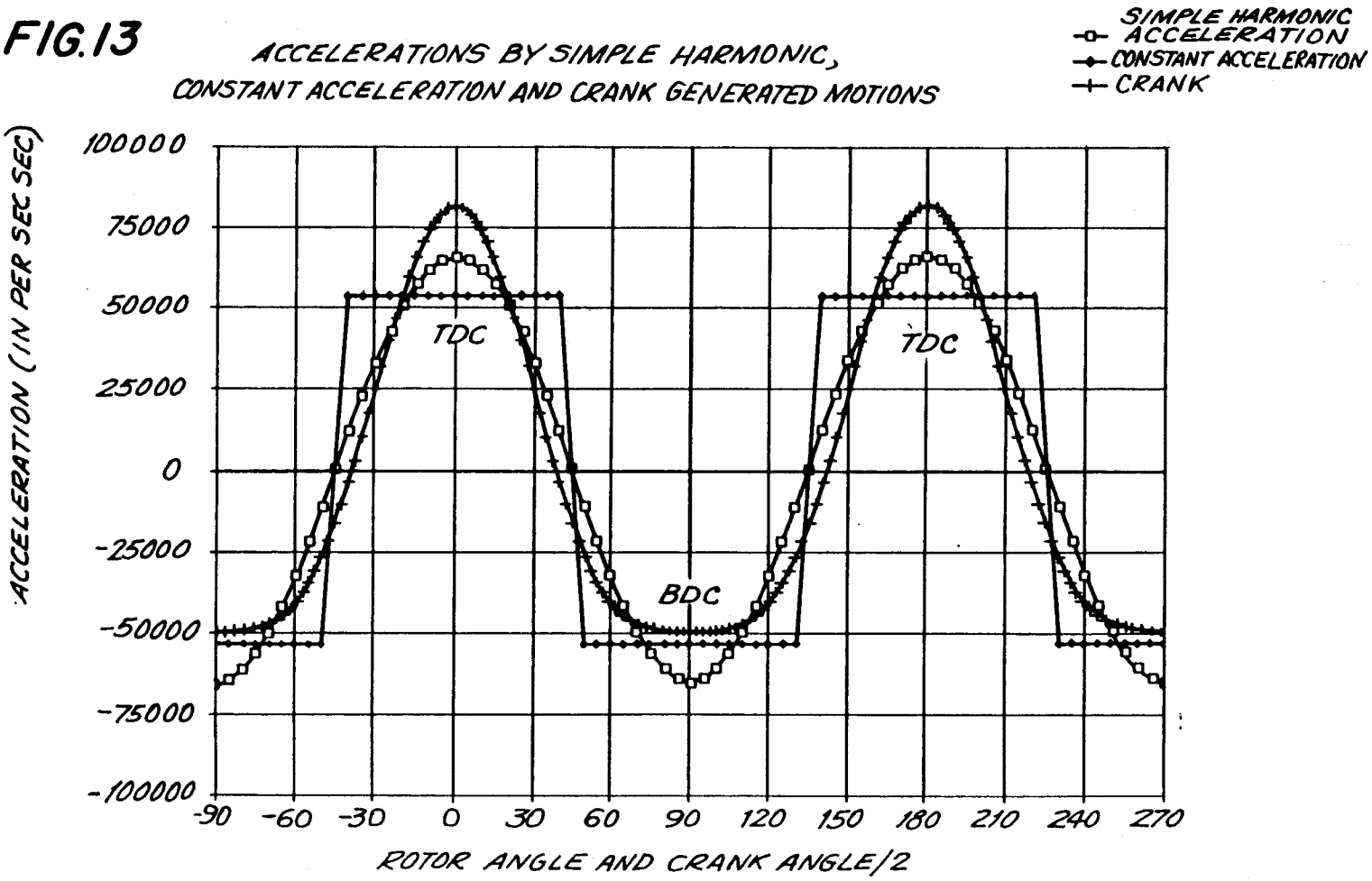
FIG. 13 is a graph depicting piston acceleration for different cam profiles in an engine constructed in accordance with an embodiment of the present invention, with piston accelerations for a conventional crank shown for comparision.

For even lower inertial stresses, a cam profile generating substantially constant piston reciprocating acceleration may be employed. In a constant acceleration configuation, the piston accelerates radially to a point at a substantially constant positive rate. At that point, the direction of acceleration reverses, and continues at a substantially constant but negative rate of acceleration. Calculated inertial stresses on a piston due to reciprocation for a constant acceleration configuration are depicted graphically in FIG. 13, along with calculated inertial stresses for simple harmonic and crank generation motions for comparison.

For applications where smooth power output and high efficiency is desired, the configuration having an expansion stroke of greater than 90°, preferably 110°, may be employed. The 110° also results makes possible a lower idle speed, because of the 20° overlap in power strokes for a four cylinder, four stroke design, thus resulting in lower fuel consumption in stop and go traffic where a significant amount of time is spent at idle.

Other cam profiles may be employed wherein the piston has a longer expansion stroke than intake stroke. This allows the high pressure combustion gases to expand to closer to ambient pressure before exhausting the gases, resulting in higher efficency and lower heat rejection, and thereby less fuel consumption.

Another configuration is one where the piston moves very rapidly toward top dead center prior to the initiation of combustion to minimize the time for pre-ignition to occur. This allows higher compression ratios with lower quality fuels, resulting in higher efficiency and lower fuel costs.

Still another configuration is one where the piston moves very rapidly off top dead center following the initiation of combustion to minimize the time during which hot products of combustion are in contact with relatively cool cylinder walls, thus contributing to less heat loss and higher efficiency. The rapid expansion causes a rapid decrease in pressure and temperature, which decreases the garnering of pollutants, such as oxides of nitrogen, because there is less time at the high pressure and temperature at which oxides of nitrogen are formed.

The cam can also be configured to provide a full exhaust stroke to maximum TDC and a full intake stroke from maximum TDC to BDC irrespective of the compression ratio to yield better breathing and scavenging without valve overlap. Valve overlap (i.e., where both the exhaust and intake valves are open) can increase emissions.

These various cam profiles can be combined together in compromise profiles, and a myriad of other cam profiles can be adopted for other custom requirements.

Turning now to FIGS. 1 and 2, a preferred embodiment of the rotary engine of the present invention incorporating a novel oil cooling and lubricating system is depicted. In this system, a sump 300 containing oil is preferably positioned directly below housing 14. Oil from the sump 300 is withdrawn through suction line 301 into oil pump 302. This oil pump is driven by means of a gear set 315 driven by shaft 110. Oil pumped from oil pump 302 is pumped into discharge line 307A and through filter 305 to remove particulates. Oil after having passed through filter 305 is discharged into discharge line 306B and then through oil cooler 307, which may be either air or water cooled. Since oil pump 302 only operates when shaft 110 is rotating, the oil cooling and lubricating system preferably includes an electric oil pump 303 for shut down cooling and lubricating, and for lubricating prior to start up of the engine. Electric oil pump 303 also takes intake from sump 300 through an intake line 301 and discharges through a check valve 304 into discharge line 307A, then through filter 305 and oil cooler 307 in the same manner as for oil pumped from oil pump 302.

Instead of (or in addition to) positioning oil cooler 307 on discharge line 306B, an oil cooler 307' can be included on the oil return line 400 just up stream of the sump 300 to cool the oil just before the oil enters oil sump 300.

Oil, after having been cooled by means of oil cooler 307, passes into a stationary line 307C and into rotating oil inlet 308 to the engine rotor. Because inlet 308 rotates with respect to oil discharge line 307C, a rotating oil seal 310 is included to prevent leakage of oil.

A side stream of oil is taken from discharge line 307C and into line 309 to cool the rear face 191 of static seal plate 190 in the manner previously described. Oil from passageway 309 passes adjacent rear face 191 to cool the static seal plate and is discharged into oil return line 400.

Oil from passageway 308 passes into the head end 311 of cooling jacket 320. Head end 311 includes a plurality of generally radially inwardly oriented walls or fins 313, which are substantially parallel to one another. Walls or fins 313 are spaced apart from one another to form troughs 312 between fins 313. As the cylinder block 13 rotates, centrifugal force acting upon the oil will tend to cause the oil to be retained within troughs 312. The rotation of the engine block will also cause a centrifugal force field to be placed upon oil contained within each of the troughs 312 thereby tending to increase the natural convective forces acting upon oil within each trough, because oil within each trough tends to be heated at the radially inward "bottom" of the trough and tend to "rise" away from the rotational center to be replaced by cooler oil. By "natural convective force" is meant the tendency of hot, less dense, fluid to rise above and be displaced by cooler, more dense, fluid under gravitational or other acceleration forces due to the difference in their densities, as distinguished from convection due to pumping the fluid by mechanical means past the surface to be cooled. In the present invention, centripital acceleration caused by rotation of the engine block substitutes for gravitational acceleration in the "natural" convention. Thus, cooler oil will tend to be forced into the bottom of each trough 312 while hotter oil will tend to be displaced over the tops of walls 313 and radially outwardly. After passing through the head end 311 of the oil cooling jacket oil exits at 314, and into the oil jacket 320 around the cylinder 31.

This heated oil will continue to pass through oil cooling jacket 320 adjacent cylinder 31 to cool the cylinder until the oil reaches an oil hole 321. Oil hole 321 is oriented so as to spray the discharge oil onto the cam follower 51 to cool and lubricate the cam follower. Oil return lines 400 are included on the bottom of housing 14 to allow the spent oil to return to oil sump 300.

In addition to passing into oil cooling jacket 320, a side stream of oil from rotor inlet 308 passes into a lubricating line 317, and hence through inboard rotor bearing 318 and then into oil cooling jacket 320, and a side stream passes to outboard rotor bearing 319, then to the driving gear set 315 for oil pump 302, and then to oil return line 400 to be returned to pump 300 to cool and lubricate these parts.

Because engine block 13 is rotating, centrifugal forces acting on the oil contained within oil cooling jacket 320 will tend to force the oil radially outwardly. Because of this, a smaller oil pump 302 then would be necessary in a conventional engine its required, resulting in greater net power output from shaft 110. In addition, because oil is used for cooling, as well as for lubricating, no water jacket around the cylinders is required. Furthermore, the engine block also transfers heat to the housing indirectly by heating the air within the housing, which in turn transfers its heat to the housing. This indirect cooling is assisted by rotation of the engine block within the housing, which causes movement and mixing of the air in the housing.

The inner surface of piston head 101 and wrist pin 81 are cooled and lubricated by means of oil thrown off the surface of cam follower 51 as it rotates. Finally, another oil spray hole 322 is provided on the outside of oil cooling jacket 320 directed to the pivot 173 of rocker arm 170 to provide lubrication of this pivot. In this manner, a very simple and reliable oil cooling and lubricating system which eliminates the need to use direct air or water cooling of the cylinders is provided. In addition to simplifying the construction, the use of oil cooling in accordance with the present invention allows the engine to run hotter, resulting in higher efficiency.

Figure 6A:
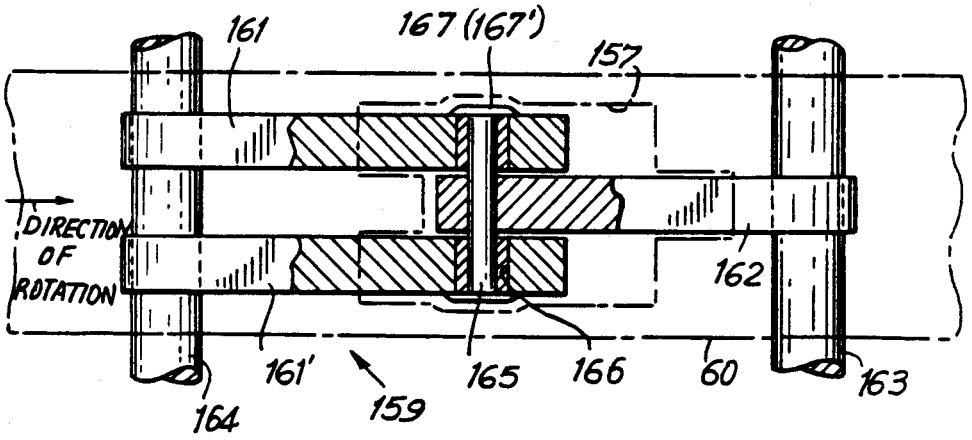
FIG. 6A is an enlarged sectional view taken along the line 6A—6A of FIG. 6, showing the construction of one embodiment of the adjustable cam track segment.
Figure 6:
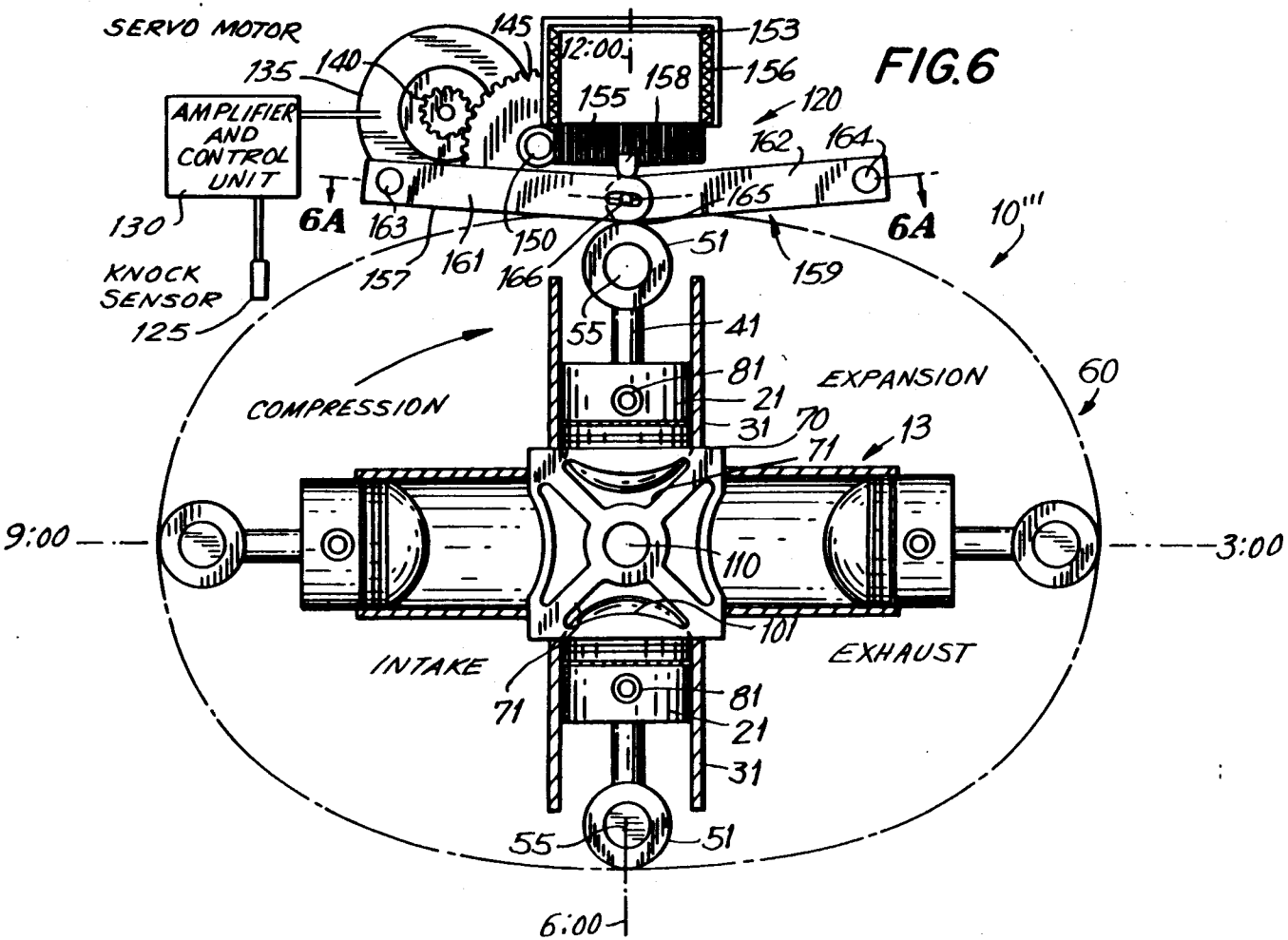
FIG. 6 is a diagrammatic sectional end view of a rotary engine in accordance with the present invention, showing another embodiment of the means for varying the compression ratio, including an adjustable cam track segment.
Figure 7:
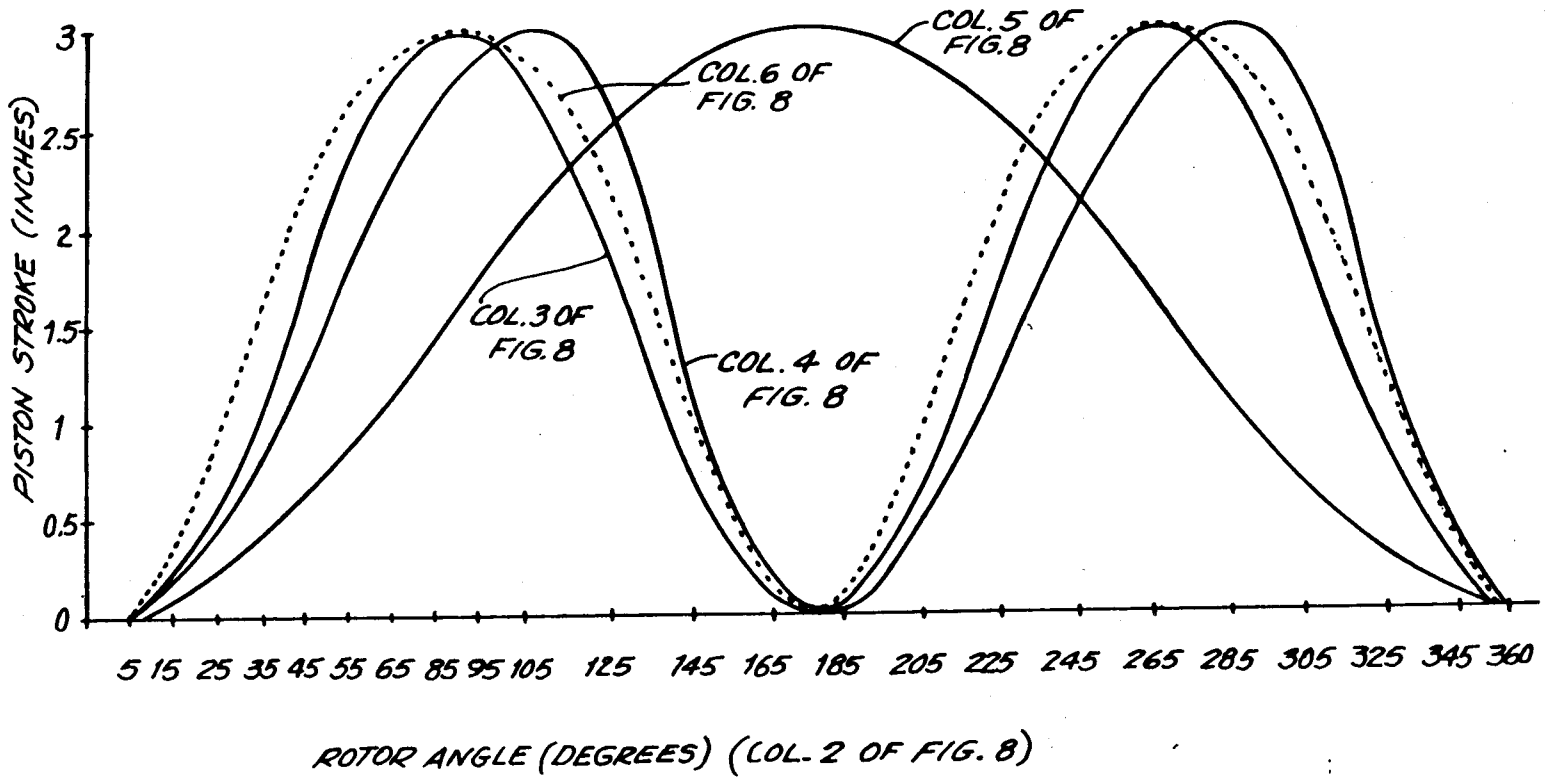
FIG. 7 is a graph of piston motions as functions of rotor angle in accordance with different embodiments of the present invention, and of piston motions in a crank-type engine for comparison purposes.

In order to make most effective use of available fuels, the engine in accordance with the present invention preferably includes means for varying the compression ratio in each cylinder assembly 30 while the engine is operating. In accordance with one embodiment of the present invention, depicted in FIGS. 6 and 6A as engine 10''', compression can be varied while the engine is operating by means of a compression control system 120. Compression control system 120 includes a knock sensor 125, which is preferably a piezoelectric crystal. Knock sensor 125 detects the commencement of engine knock in the cylinder assemblies 30. Signals from knock sensor 125 are fed into an amplifier and control unit 130. Amplifier and control unit 130 control the power input to a servomotor 135 to cause the servomotor to rotate in one direction, tending to decrease compression when engine knock is detected, and to rotate in the opposite direction to increase compression when engine knock is not detected.

Servomotor 135 has an output gear 140 which drives a reduction gear 145. Reduction gear 145 in turn drives a ramp drive worm gear 150. Worm gear 150, in turn, rotates ramp drive threads 155, causing drive element 153 to rotate axially thereby rotating acme threads 156 in and out. This causes ramp drive rod 158 to either extend or retract, depending on the rotational direction of servomotor 135. Ramp drive rod 158 is connected to a movable cam track segment 159, which is positioned in an opening 157 in cam track 60. Of course, other means of moving the cam track segment 159, such as a hydraulic cylinder can be used, and there is no intention of limiting the invention to the exemplary embodiment shown.

Movable cam track segment 159 is comprised of a leading ramp 161 (and 161') and a trailing ramp 162 interdigitatably connected to one another by means of center joint pivot 166 having pivot head 167 and 167'. Center joint pivot 166 is suitably connected to trailing edge 162, and extends through a slot 165 (and 165') in leading ramp 161. Trailing ramp 162 is pivotably mounted by means of pivot 164, and leading ramp 161 is pivotably mounted about pivot 163. As ramp drive rod 158 moves in and out in response to the motion of servomotor 135, leading ramp 161 and trailing ramp 162 will be pivotably moved in response thereto from radially further positions to radially closer positions. Accordingly, as cam follower 151 rotates about cam track 60, when it reaches leading ramp 161, it will be compelled to ride along leading ramp 161 until it reaches trailing ramp 162 and will ride along trailing ramp 162 until it reaches the continuation of cam track 60. Thus, the path of cam follower 51 can be altered by moving leading ramp 161 and trailing ramp 162 radially inwardly or outwardly, either manually or automatically depending upon engine load or other engine parameters. For example, engine parameters such as engine temperature, exhaust temperature, intake air temperature, engine speed could be fed into a suitably programmed microprocessor to effect the control function. Thus, the highest compression possible, without engine knock, that is possible for a given fuel and engine load can be accomplished, resulting in increased engine efficiency. Furthermore, the compression can be reduced prior to starting the engine and kept low until just after the engine starts to decrease the power required to crank the engine. Also, the compression can be lowered, manually or automatically, at idle. This reduces torque variation and thereby reduces the stable idle speed and fuel consumption at idle.

The compression ratio in the engine of the present invention can be varied as much as desired, but a particularly desirable range is from a low of 7:1 to 17:1. This range allows use of a wide variety of fuels in a spark ignition engine previously believed to be impossible. For example, it is believed that even jet fuel can be carbureted and used successfully in an engine of the present invention, when the compression is lowered to about 7:1. When higher octane fuel is available, the compression ratio can be raised to allow higher efficiency commensurate with the quality of the fuel.

An alternate embodiment of the rotary engine of the present invention having means for varying the compression ratio during operation is depicted in FIGS. 3 and 4. As depicted therein, the rotary engine 10 includes driving gear 200 which is mounted to output shaft 110. Driving gear 200 drives a first idler gear 201, which, in turn, drives a second idler gear 202. Idler gear 202 drives a driven gear 203 which is connected to a compressor cam 204. Thus, as the rotatable engine block 13 rotates, compressor cam 204 will be rotated a corresponding number of degrees by gears 200, 201, 202 and 203.

Compressor cam 204 includes four lobes, each having a peak 206 and a notch 205 on the trailing side of the cam. As cam 204 rotates, it acts upon a driven roller 207 which is mounted to a movable cam track segment 209 by means of roller axle 208. Movable cam track segment 209 is pivotably attached by means of pivot 210 to housing 14.

In operation, movable cam track segment 209 is in the radially outward position, i.e. with its leading edge substantially flush with the remainder of cam track surface 60. As engine block 13 rotates into position, and cam follower 51 rotates sufficiently so that it is entirely upon the leading portion of the movable cam track segment 209, cam compressor 204 rotates correspondingly to a position where peak 206 acts upon driven roller 207 to cause movable cam track segment 209 to pivot radially inwardly, thereby driving cam follower 51 and hence piston 21 into a position of higher compression. This compression is effected relatively quickly because of the cam action of cam compressor 204. Because pre-ignition is time-dependent, that is the faster the compression the less likely pre-ignition is to occur with the same compression ratio, the rapid compression imparted by cam 204 minimizes the propensity for pre-ignition even at high compression ratios. Therefore, much higher compression ratios, in the range of 18:1, can be used resulting in higher efficiency then is possible in engines of the prior art with relatively slow compression. In this embodiment, inner cam track 65 has an indentation 66 near 12:00 top dead center. Indentation permits movable cam track segment 209 to move cam follower 51 radially inwardly without interference with inner cam track 65 at that point. Because the region around 12:00 top dead center is always under relatively high pressure (due to compression and combustion) cam follower 51 will always be firmly held against outer cam track 60 at this position, irrespective of the lack of an inner cam track at this position.

As cam 204 continues to rotate, driven roller 207 will fall into notch 205 causing the cam track segment 209 to rapidly return to a relatively flush position with the remainder of cam track 60. This quickly reduces pressure and temperature of the combustion gases, resulting in higher efficency and lower emission of nitrous oxides. Thus, as cam follower 51 continues past the cam track segment 209, when it reaches cam track 60, movable cam track segment 209 will be relatively flush with cam track 60 to allow the cam track roller 51 to continue unimpeded, and ready for another cycle with the next piston assembly.

Turning now to FIG. 5, an embodiment of the present invention utilizing a device for selectively locking a particular piston and linkage assembly so that it does not reciprocate as the engine block 13 rotates is depicted. This locking device includes a plunger lock 801 fixedly mounted to cylinder 31. Plunger lock is preferably a solenoid but could be a hydraulic cylinder. Plunger lock 801 includes a centrally disposed plunger pin 802. Rocker arm 170 includes a mating hole 803 which is adapted to receive plunger pin 802. When rocker arm 170 is in the appropriate position, i.e. with the piston substantially at the top dead center of its stroke, plunger lock 801 can be selectively energized to drive plunger pin 802 into mating hole 803. Once engaged in mating hole 803, rocker arm 170 will be locked and piston 21 will not be able to reciprocate as engine block 13 rotates. Of course, in this embodiment, inner cam track 65 would not be used because it would interfere with the motion of cam follower 51. Furthermore, this structure enables the engine of the present invention to continue to run even if one or more pistons seize. By selectively disengaging pistons from reciprocating, only the number of pistons necessary to supply the required load will be operating, which results in higher efficiency.

Plunger lock 801 can be operated manually, or automatically in response to engine load or other engine parameters. When operated automatically, an engine sensor 804 is provided responsive to engine parameters, such as engine speed and throttle position. When engine load is low, control means 805 can actuate plunger lock 801 at the point in the rotation of engine block 13 where mating hole 803 is aligned with plunger pin 802. When engine load increases to the point that additional cylinders are required, control means 805 disengages plunger pin from mating hole 803 at the same, approximately top dead center, position of the piston.

An engine in accordance with the present invention is an ideal power plant for propeller driven light airplanes. In light airplanes, the propeller speed generally does not exceed about 2500 revolutions per minute ("rpm"). Because 2500 rpm is a relatively low speed for conventional crank type engines, reduction gearing between the engine and the propeller is frequently necessary so that the engine can run at a higher, more efficient speed. In a rotary engine in accordance with the present invention, the shaft speed is one half that of a crank-type engine having the same displacement and number of cylinders. That is, a power stroke occurs for each cylinder of the rotary engine in accordance with a prefered four-stroke embodiment of the present invention once every shaft revolution, whereas in a crank-type four stroke engine, a power stroke occurs every other revolution. Thus, the rotary engine of the present invention rotates slowly enough to be directly coupled to a light airplane propeller without reduction gearing, while having the high efficency of an "effective" speed (compared to an equivalent crank-type engine) of twice its actual shaft speed.

Figure 10:
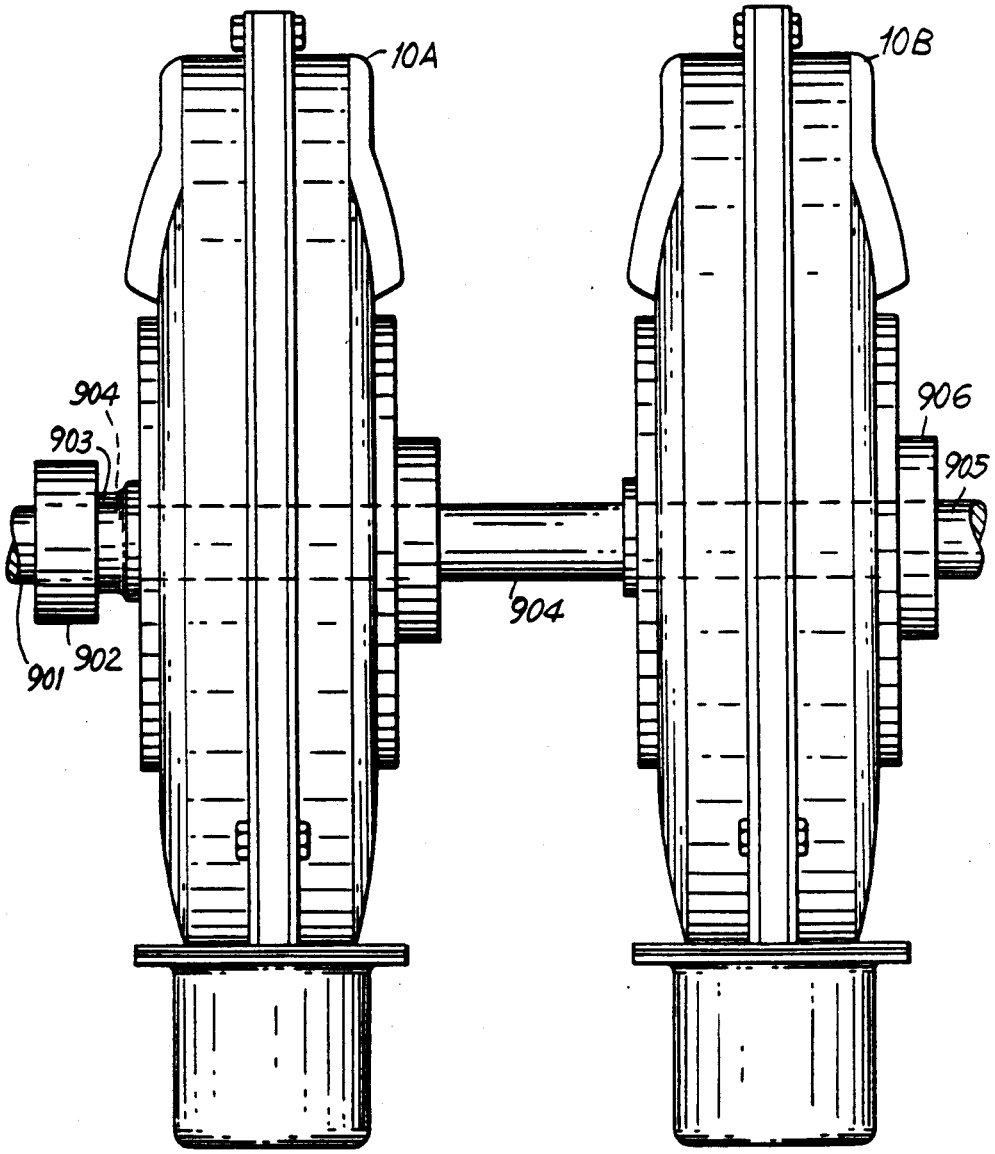
FIG. 10 is a side view of a multibank embodiment of the present invention, including two rotary engines connected together in series.

Reference is now made to FIG. 10 showing an alternate embodiment of the present invention wherein two similar engines 10A and 10B are provided on the same drive shaft 901. In this construction each of the engine blocks 13 associated with the respective engine is coupled to drive shaft 901 by free wheeling bearings in a hydraulically actuated clutch assembly 902. The engine block 13 of engine 10A and its output shaft 903 are hollow to permit output shaft 904 of engine 10B to pass therethrough to connect with hydraulic clutch 902. Hydraulic clutch 902 is operable to selectively couple either or both of output shafts 903 and 904 to the drive shaft 901. When both engines are coupled, the output shafts of the engines preferably rotate in the same direction at the same speed.

Engine 10B may also include an input shaft 905 and another hydraulic clutch 906. Input shaft 905 can lead from another engine and be connected to engines 10A and 10B by hydraulic clutch 906. Thus, as many engines as desired can be banked together in series in this manner, the output shaft of one engine extending through a hollow rotor and output shaft of the next engine in the series. Thus, if some of the engines were operating and the others were not, the other engines could remain idle on the output shaft without creating a drag to the operation of the other engines.

The banked engine concept shown in FIG. 10 may be utilized where the expected load to be driven will vary and at times two engines may be needed while at other times only one engine will be sufficient to provide the power output requirement necessary. Hence, during periods of high torque load demand both engines would be engaged on the drive shaft and, after high torque load demands have subsided, one of the engines can be stopped, the hydraulic clutch disengaged and that engine remain stationary and idle while other engine powers the output shaft.

To do so, clutch 902 can be disengaged engaged so that engine 10B is actuated only in high torque load demand situations. After a period of engine use, clutch 902 is placed in a state so that engine 10B operates continuously while engine 10A operates only intermittently. In this way engine wear is shared by the plurality of engines in the bank. Thus, after a period of continuous use, a particular engine is relegated to standby use while another engine, which previously has operated only intermittently, is relegated to continuous operation.

Where the banked engine concept of the present invention is used for automobile power plants the switching of the engine can be accomplished after fifty thousand miles of operation and in essence a relatively new engine will assume the major burden of power output requirement while the engine which has functioned continuously for the fifty thousand miles is relegated to intermittent duty.

Figure 11:
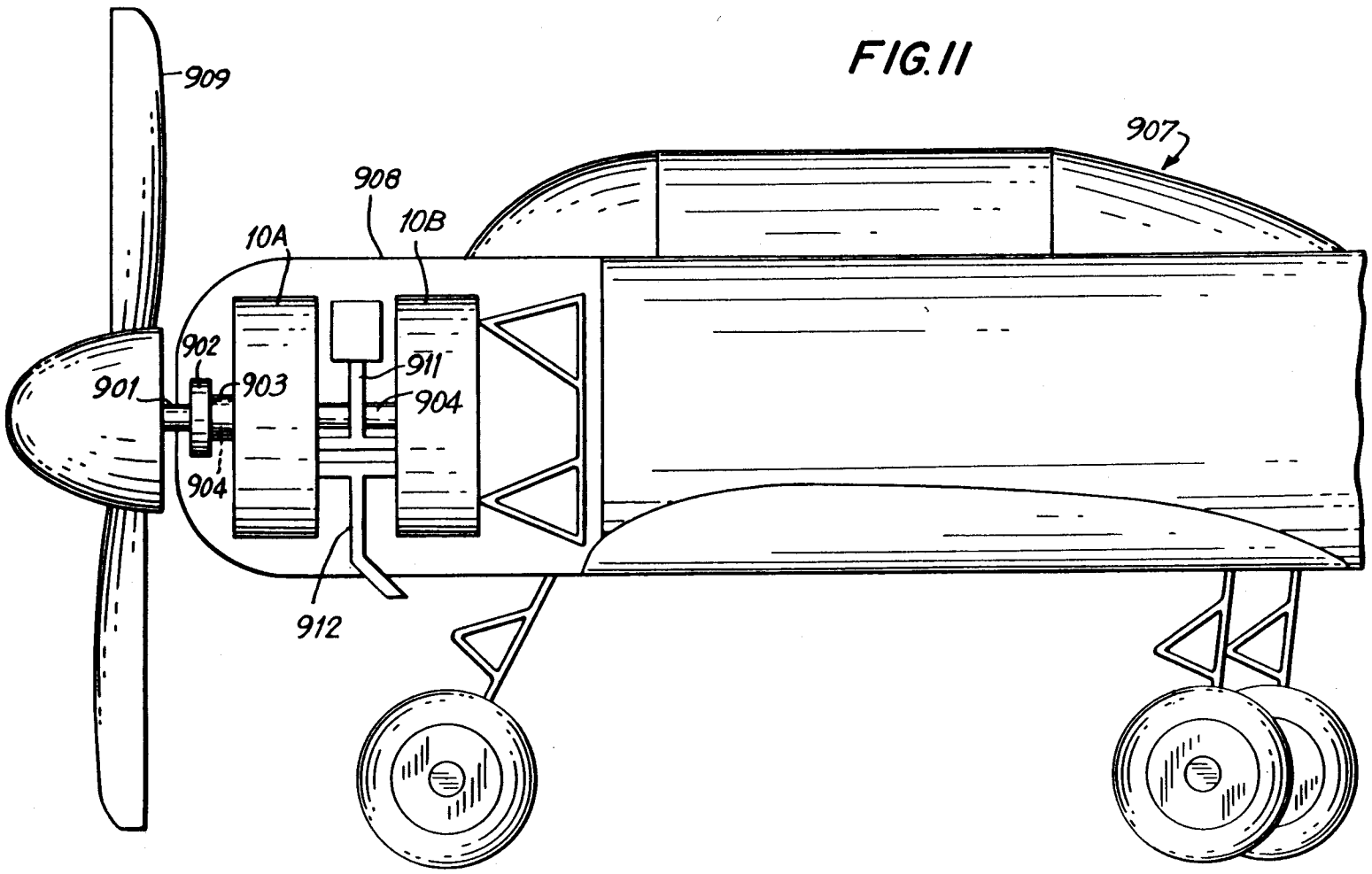
FIG. 11 is a partially cutaway view of a propeller driven light airplane including a two bank rotary engine in accordance with and embodiment of the present invention.

Engines in accordance with the present invention, and particularly multibanked engines, are particularly well suited for driving light airplane propellers, because the "extra" engine provides an additional margin of safety in case of failure of one of the engines. FIG. 11 depicts a light propeller driven airplane 907 including a two bank embodiment of the present invention. The airplane includes a fuselage 908 and a propeller 909 driven by propeller drive shaft 901 extending from two similar rotary engines 10A and 10B connectable together in series. The intake line 911 and exhaust line 912 to and from the static valve plates are conveniently positioned between the two engines 10A and 10B, respectively. Each of engines 10A and 10B can be selectively coupled or decoupled from the propeller drive shaft 901 by means of hydraulic clutch 902. In this manner, the safety and power of two independent engines can be provided, while retaining the simplicity and cost savings of a single propeller design.

Although the invention has been described in accordance with preferred embodiments, it will be seen by those skilled in the art that many modifications can be made within the spirit and scope of the present invention, and no intention is made to limit the scope of the present invention to any of these embodiments. Rather, the scope of the present invention is to be measured by the appended claims.

What is claimed is:

1. A rotary internal combustion engine, said engine comprising:

a housing;

a cam track internally disposed within said housing and adapted to receive a cam follower;

an engine block disposed within said housing, said engine block and said housing being relatively rotatable with respect to each other about a central axis;

means connectable to an external drive member for translating said relative rotation of said engine block with respect to said housing into useful work;

at least one radially arranged cylinder assembly on said block, each cylinder assembly including a cylinder having a longitudinal axis extending generally radially outwardly from the rotational axis of said block, said cylinder including means defining an end wall, a piston member disposed within said cylinder and adapted to reciprocate within said cylinder;

said piston, cylinder and cylinder end wall together defining a combination chamber, means permitting periodic introduction of air and fuel into said combustion chamber, means for initiating combustion of a compressed mixture of air and fuel within said combustion chamber, means permitting periodic exhaust of products of combustion of air and fuel from said combustion chamber, and means for imparting forces and motions of said piston within said cylinder to and from said cam track, said means comprising linkage means and a cam follower operatively connected to said linkage means, said linkage means comprising a connecting rod having a first end portion pivotally connected to said piston member and a second end portion; a rocker arm having a first end portion pivotally mounted to a mounting point fixed with respect to said block and offset with respect to the longitudinal axis of its associated cylinder, a second end portion pivotally connected to said second end portion of said connecting rod, and an arm portion connecting said first and second end portions of said rocker arm; said cam follower being operatively connected by means of an axle to said arm portion of said rocker arm and being adapted to ride along said cam track so that said cam follower forces and motions are transmitted to and from said piston through said linkage means to and from said cam track;

wherein said cam track includes at least a first segment and at least a second segment thereof, said first segment having a generally positive slope wherein said segment has a generally increasing radial distance from the rotational axis of said engine block whereby as a piston moves outwardly in a cylinder on a power stroke while the cam follower is in radial register with said cam track segment, the reactive force of the respective cam follower through said linkage means against the cam track segment acts in a direction tending to impart rotation to said engine block in the direction of the positive slope of said cam track segment, said second segment having a generally negative slope wherein said segment has a generally decreasing radial distance from the rotational axis of said engine block whereby as a cam follower rides along said negative slope of said cam track as said engine block rotates, said cam follower will cause a geometrically defined motion of said linkage means to compel a radially inward motion of the respective piston in its respective cylinder.

2. The engine as defined in claim 1, wherein said arm portion has a radially inwardly open "V" bend, and said cam follower axle is located substantially at the apex of said "V" bend.

3. The engine as defined in claim 1, wherein said housing is stationary and said engine block rotates.

4. The engine as defined in claim 1, wherein said engine block is stationary and said housing rotates.

5. The engine as defined in claim 3, wherein said first end portion of each respective rocker arm further includes a counterweighted free end extending from said mounting point in a direction generally away from the longitudinal axis of said cylinder whereby centrifugal forces acting upon the respective piston, linkage means and cam follower will be counterbalanced to a substantial degree by centrifugal forces acting upon the free end of said respective rocker arm.

6. The engine as defined in claim 1, wherein said cam follower is a roller rollable along at least a portion of said cam track.

7. The engine as defined in claim 1, wherein said cam track is an outer cam track and wherein said device further includes an inner cam track spaced apart from and substantially parallel with said outer cam track and wherein said cam follower is adapted to closely fit between said outer track and said inner track.

8. The engine as defined in claim 1, wherein said end wall of each respective cylinder is a head fixed with respect to its respective cylinder.

9. The engine as defined in claim 1, wherein said said cam track has a shape such that each respective piston has a substantially longer power stroke than intake stroke.

10. The engine as defined in claim 1, wherein said said cam track has a shape such that each respective piston has a simple harmonic motion.

11. The engine as defined in claim 1, wherein said said cam track has a shape such that each respective piston has a power stroke greater than 90 degrees of relative rotation of said engine block.

12. The device as defined in claim 1, wherein said means for initiating combustion of a compressed mixture of air and fuel with said combustion chamber includes means for highly compressing the air during the compression stroke of the piston within said combustion chamber to the degree necessary to ignite the fuel by means of heat caused by compression of the air within said combustion chamber.

13. The device as defined in claim 1, wherein said means for initiating combustion of a compressed mixture of air and fuel with said combustion chamber includes a spark plug for igniting the air and fuel mixture by means of an electrical spark.

14. The rotary internal combustion engine as defined in claim 1, wherein said engine operates on a four stroke cycle.

15. The rotary internal combustion engine as defined in claim 1, wherein said engine operates on a two stroke cycle.

16. The engine as defined in claim 1, wherein said cam track has a shape such that each respective piston has substantially positive and negative constant acceleration.

17. A light airplane comrising a propeller and a rotary internal combustion engine operatively connected to said propeller to drive said propeller, said rotary engine comprising a housing;

a cam track internally disposed within said housing and adapted to receive a cam follower;

an engine block disposed within said housing, said engine block and said housing being relatively rotatable with respect to each other about a central axis;

means connectable to an external drive member for translating said relative rotation of said engine block with respect to said housing into useful work;

at least one radially arranged cylinder assembly on said block, each cylinder assembly including a cylinder having a longitudinal axis extending generally radially outwardly from the rotational axis of said block, said cylinder including means defining an end wall, a piston member disposed within said cylinder and adapted to reciprocate within said cylinder;

said piston, cylinder and cylinder end wall together defining a combustion chamber, means permitting periodic introduction of air and fuel into said combustion chamber, means for initiating combustion of a compressed mixture of air and fuel within said combustion chamber, means permitting periodic exhaust of products of combustion of air and fuel from said combustion chamber, and means for imparting forces and motions of said piston within said cylinder to and from said cam track, said means comprising linkage means and a cam follower operatively connected to said linkage means, said linkage means comprising a connecting rod having a first end portion pivotally connected to said piston member and a second end portion; a rocker arm having a first end portion pivotally mounted to a mounting point fixed with respect to said block and offset with respect to the longitudinal axis of its associated cylinder, a second end portion pivotally connected to said second end portion of said connecting rod, and an arm portion connecting said first and second end portions of said rocker arm; said cam follower being operatively connected by means of an axle to said arm portion of said rocker arm and being adapted to ride along said cam track so that said cam follower forces and motions are transmitted to and from said piston through said linkage means to and from said cam track;

wherein said cam track includes at least a first segment and at least a second segment thereof, said first segment having a generally positive slope wherein said segment has a generally increasing radial distance from the rotational axis of said engine block whereby as a piston moves outwardly in a cylinder on a power stroke while the cam follower is in radial register with said cam track segment, the reactive force of the respective cam follower through said linkage means against the cam track segment acts in a direction tending to impart rotation to said engine block in the direction of the positive slope of said cam track segment, said second segment having a generally negative slope wherein said segment has a generally decreasing radial distance from the rotational axis of said engine block whereby as a cam follower rides along said negative slope of said cam track as said engine block rotates, said cam follower will cause a geometrically defined motion of said linkage means to compel a radially inward motion of the respective piston in its respective cylinder.

* * * * *